US007283636B2

(12) United States Patent
Nishimura et al.

(10) Patent No.: US 7,283,636 B2
(45) Date of Patent: Oct. 16, 2007

(54) PLANAR SPEAKER

(75) Inventors: Takeshi Nishimura, Tokyo (JP); Kenji Iizuka, Tokyo (JP); Masayuki Ishiwa, Tokyo (JP); Shigeo Yamaguchi, Tokyo (JP); Tsutomu Yokoyama, Tokyo (JP); Masaaki Arahori, Tokyo (JP); Hideharu Yonehara, Tokyo (JP); Hiroshi Ikeda, Tokyo (JP); Sadaaki Sakurai, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 10/504,850

(22) PCT Filed: Feb. 28, 2003

(86) PCT No.: PCT/JP03/02390

§ 371 (c)(1),
(2), (4) Date: Feb. 8, 2005

(87) PCT Pub. No.: WO03/073787

PCT Pub. Date: Sep. 4, 2003

(65) Prior Publication Data

US 2005/0152577 A1 Jul. 14, 2005

(30) Foreign Application Priority Data

Feb. 28, 2002 (JP) ..... 2002-053763
Aug. 28, 2002 (JP) ..... 2002-248138

(51) Int. Cl.
*H04R 25/00* (2006.01)

(52) U.S. Cl. ..... 381/152; 381/408; 381/431

(58) Field of Classification Search ..... 381/408, 381/409, 410, 423, 424, 426, 431, 399, 176, 381/400–402; 181/170, 173; 29/594, 609.1
See application file for complete search history.

(56) References Cited

U.S. PATENT DOCUMENTS 4,471,173 A * 9/1984 Winey ..... 381/408
5,003,610 A * 3/1991 Adachi et al. ..... 381/431
5,627,903 A * 5/1997 Porrazzo et al. ..... 381/423

FOREIGN PATENT DOCUMENTS

| | | |
|---|---|---|
| JP | 51-26523 | 3/1976 |
| JP | 1-144799 | 6/1989 |
| JP | 8-140185 | 5/1996 |
| JP | 2001-333493 | 11/2001 |

* cited by examiner

*Primary Examiner*—Huyen Le
(74) *Attorney, Agent, or Firm*—Oblon, Spivak, McClelland, Maier & Neustadt, P.C.

(57) ABSTRACT

The present invention provides a planer acoustic transducer including a vibrating diaphragm including a spiral voice coil provided on both surfaces or on one surface of an insulating base film; and a permanent magnet corresponding to the voice coil, wherein, in the vibrating diaphragm, the spiral voice coil is formed by applying a wire conductor, in a coil pattern, onto a sheet-like substrate having an adhesive layer on at least one surface thereof. Alternatively, at least a portion of the vibrating diaphragm, which portion corresponds to the loop of a first or second vibration mode, is reinforced with a rigidity-imparting member; the substrate of the vibrating diaphragm is formed of a resin foam; or the voice coil is formed three-dimensionally.

15 Claims, 29 Drawing Sheets

(A)

SINGLE STRAND WIRE (B)

LITZ WIRE

× : LOCATIONS OF WIRE BREAKAGE

A-A' CROSS SECTION

PLANAR SPEAKER

TECHNICAL FIELD

The present invention relates to a thin, planer acoustic transducer which exhibits less variation in impedance and produces high sound pressure. The present invention also relates to a planer acoustic transducer including a flat vibrating diaphragm.

BACKGROUND ART

FIG. 34 shows an example of a conventional thin, planer acoustic transducer. This planer acoustic transducer includes a yoke 50; a plurality of bar-shaped magnets 52 which are arranged in parallel on the yoke; a vibrating diaphragm 54 which is arranged in parallel with the pole faces of the bar-shaped magnets 52; and a plurality of coils 56 which are arranged on the vibrating diaphragm 54 at positions that face the bar-shaped magnets 52 such that current flows in a direction perpendicular to a magnetic field generated from the bar-shaped magnets 52. When alternating current is caused to flow through each of the coils 56, in accordance with Fleming's left hand rule, force is generated between the coil 56 and the magnetic field. As a result, the vibrating diaphragm 54 is vibrated in a direction perpendicular to the surface of the diaphragm, and electrical signals are converted into sound signals.

However, the aforementioned planer acoustic transducer involves problems, including generation of noise resulting from twisting of the vibrating diaphragm due to force along the surface of the diaphragm, which force occurs by the effect of the magnetic field perpendicular to the coils on the diaphragm surface, as well as low degree of freedom in the design of planer acoustic transducer shape or coil impedance, since, for example, the coils facing the bar-shaped magnets have an elongated rectangular shape, and most portions of the coils are located in regions facing the pole faces of the bar-shaped magnets.

In an attempt to improve the planer acoustic transducer of FIG. 34 involving the aforementioned problems, a planer acoustic transducer having a configuration shown in FIG. 35 has been proposed. In the planer acoustic transducer having this configuration, a plurality of magnets 62 are arranged on a yoke 60, with the magnets being in parallel with a vibrating diaphragm 64, such that the pole faces of adjacent magnets differ from each other. Furthermore, a plurality of spiral coils 66 are arranged on one surface or both surfaces of the vibrating diaphragm 64 at positions facing the pole faces of the magnets 62, such that the innermost circumference of each of the spiral coils is located in the vicinity of a portion of the vibrating diaphragm, the portion corresponding to the outer periphery of each of the pole faces. In FIG. 35, reference numeral 68 denotes a damper.

With the configuration shown in FIG. 35, force which the coils receive from a magnetic field perpendicular to the vibrating diaphragm is reduced, and generation of noise is suppressed. In addition, the portions of the coils that are perpendicular to a magnetic field in parallel with the vibrating diaphragm are increased in area, whereby sound conversion efficiency is enhanced, and the degree of freedom in the design of planer acoustic transducer shape or coil impedance is increased as compared with the case of the planer acoustic transducer of FIG. 34.

In the aforementioned conventional planer acoustic transducers, generally, coils are formed on a vibrating diaphragm by means of the below-described method. Specifically, through holes are formed, by means of drilling, through-hole plating, etc. in a substrate sheet prepared by forming a metallic layer on both surfaces of a resin-made film (e.g., a polyimide film or polyester film) through a technique such as sputtering, plating, or application of metallic foil, or in a composite sheet prepared by bonding metallic foil (e.g., copper foil or aluminum foil) onto a substrate such as a prepreg formed by impregnating glass cloth, aramid non-woven fabric, or the like with an epoxy resin, a thermosetting polyester resin, or the like; and subsequently, unnecessary portions of the metallic foil are removed by means of a process similar to that employed for producing a printed wiring board, such as etching, to thereby form coils.

Alternatively, the below-described method is employed for forming coils on a vibrating diaphragm. Specifically, a coil pattern and through-holes (conducting portions) for electrically conducting circuits on both surfaces of a substrate are formed, by means of metal plating, directly on the substrate, such as a sheet prepared by thermally curing a resin-made film (e.g., polyimide film or polyester film) or a prepreg formed by impregnating glass cloth, aramid non-woven fabric, or the like with an epoxy resin, a thermosetting polyester resin, or the like.

The vibrating diaphragm produced through the above-described method generally has a configuration as shown in FIG. 36. In FIG. 36, reference numeral 70 denotes a substrate film, 72 a coiled circuit, and 74 a through-hole connection portion.

However, the aforementioned conventional coil formation methods involve problems. Specifically, in the case of the method in which through-holes are formed in a film substrate having a metallic layer on both surfaces thereof, and then coils are formed through etching (among printed wiring board production methods, this method is called a "subtractive method"), under some etching conditions, a portion of the coils may be excessively etched, and the width of conductors constituting the coils may be reduced, leading to an increase in impedance and, in the worst case, occurrence of circuit breakage. Meanwhile, this method tends to cause problems, including a decrease in impedance, which results from occurrence of short circuit between adjacent conductor or an increase in the width of the conductors due to insufficient etching.

In the case of the method in which coils are formed directly on a substrate by means of metal plating (among printed wiring board production methods, this method is called an "additive method"), for example, difficulty is encountered in maintaining uniform thickness of conductors in all the coils during plating of the coils; i.e., the degree of freedom in the design of planer acoustic transducer impedance becomes low.

Each of the aforementioned conventional methods also involves problems in that a complicated process is required for production of a vibrating diaphragm, variation in the impedance of the thus-produced vibrating diaphragm is large, and production cost is high.

In the case where coils are formed by means of the subtractive method or the additive method, difficulty is encountered in arbitrarily designing the area of the cross section of coils under mass production conditions, since some limitations are imposed on the etching conditions or the plating conditions. Furthermore, in the case where coils are formed by means of the subtractive method or the additive method, since coils cannot overlap with one another on a single substrate surface, the degree of freedom in the design of impedance becomes low, and the cross-sectional area of spiral coils fails to be increased to more than 0.02 $mm^2$.

FIGS. 37(A) through 37(C) show an example of a conventional planer acoustic transducer. In the figures, reference numeral 110 denotes a flat yoke formed of an iron plate (ferromagnetic metallic plate), 112 a plurality of permanent magnets which are mounted on one surface of the yoke 110 such that the magnetic axes are perpendicular to the yoke surface, and 114 a vibrating diaphragm. The permanent magnets 112 are mounted on the surface of the yoke 110 at predetermined intervals such that the pole faces of adjacent magnets are of opposite polarity. The vibrating diaphragm 114 includes an insulating base film 116, and spiral voice coils 118 which are formed on both surfaces (or one surface) of the base film 116 such that the respective voice coils correspond to the respective permanent magnets 112. All the voice coils 118 are connected together such that current flows in the same direction at the adjacent sides of adjacent voice coils. Reference numeral 126 denotes a coating film for covering the voice coils 118.

The yoke 110 has holes 124 for regulating change in air pressure, which is caused by vibration of the vibrating diaphragm 114. The periphery of the vibrating diaphragm 114 is connected, via an elastic supporting member 128, to a yoke stepped portion 110*b* provided on a yoke peripheral wall 110*a*, and the vibrating diaphragm 114 is movably supported at a desired distance from the pole faces of the permanent magnets 112. A buffer sheet 130 is provided between the vibrating diaphragm 114 and the permanent magnets 112, so that the vibrating diaphragm 114 does not come into contact with the pole faces of the permanent magnets 112. The buffer sheet 130 may be a sheet formed of a highly resilient material, so as not to impede vibration of the vibrating diaphragm 114. Reference letter G denotes a gap between the vibrating diaphragm 114 and the buffer sheet 130, and reference numeral 122 denotes an input terminal, 132 an insulating plate, 134 an external terminal, and 136 a flexible conductor.

The aforementioned planer acoustic transducer can be configured into a thin form.

However, when the aforementioned planer acoustic transducer is used for a long period of time, metal fatigue tends to occur in the voice coils formed on the insulating base film, leading to wire breakage of the coils, since the voice coils themselves vibrate during use of the planer acoustic transducer. Metal fatigue occurs as a result of repeated application of stress to particular portions of a metallic material.

In addition, in the case of the aforementioned planer acoustic transducer, since the insulating base film, which serves as a substrate of the vibrating diaphragm, has a very small thickness; i.e., about 4 to about 100 μm, a sharp trough of sound pressure occurs within a midrange of 300 to 800 Hz, leading to deterioration of sound quality.

Furthermore, in the case of the aforementioned planer acoustic transducer, since the voice coils are provided on the vibrating diaphragm, Joule heat generated from the voice coils is readily transmitted to the vibrating diaphragm, possibly leading to degeneration of the vibrating diaphragm. Also, the vibrating diaphragm may deflect under its own weight and come into contact with the surface of the magnets, leading to deterioration of characteristics of the planer acoustic transducer.

DISCLOSURE OF THE INVENTION

A first invention of the present invention has been conceived in view of the above-described circumstances. An object of the first invention is to provide a planer acoustic transducer including a vibrating diaphragm exhibiting less variation in impedance, which planer acoustic transducer provides a high degree of freedom in the design of the shape of the vibrating diaphragm or the design of impedance. Another object of the first invention is to provide a planer acoustic transducer producing high sound pressure, which is a yardstick for sound conversion efficiency.

The present inventors have found that the aforementioned objects can be achieved by employing a wiring technique which has previously been disclosed by the present inventors in Japanese Patent Application Laid-Open (kokai) No. 11-255856; i.e., the technique in which a wiring head which is provided so as to be movable relative to the surface of a sheet-like substrate having an adhesive layer on at least one surface thereof (hereinafter the sheet-like substrate will be referred to as "adhesive sheet") is intermittently brought into point contact with the surface of the adhesive sheet, while a wire conductor is fed from the wiring head, to thereby attach the wire conductor onto the surface of the adhesive sheet in a sequential manner.

Accordingly, the first invention provides a planer acoustic transducer comprising a vibrating diaphragm including a spiral voice coil provided on both surfaces or on one surface of an insulating base film; and a permanent magnet corresponding to the voice coil, wherein, in the vibrating diaphragm, the spiral voice coil is formed by applying a wire conductor, in a coil pattern, onto a sheet-like substrate having an adhesive layer on at least one surface thereof.

The first invention also provides a planer acoustic transducer comprising a yoke having a flat portion; a plurality of magnets which are arranged on the yoke at predetermined intervals such that the pole faces of adjacent magnets are of opposite polarity; and a vibrating diaphragm having a plurality of spiral coils at positions corresponding to the pole faces of the magnets, the vibrating diaphragm being provided at a predetermined distance from the pole faces such that the diaphragm is in parallel with the pole faces, wherein, in the vibrating diaphragm, the spiral coils are formed by applying a wire conductor, in a coil pattern, onto a sheet-like substrate having an adhesive layer on at least one surface thereof.

In the first invention, the wire conductor is preferably an insulation-coated conductor whose surface layer has at least one insulating layer.

With the aforementioned configuration, the cross-sectional area and length of the conductor constituting the coils can be maintained constant, and variation in the impedance of individual vibrating diaphragms can be reduced as compared with the case of a vibrating diaphragm produced through the conventional method.

The aforementioned configuration solves a problem associated with the case where coils are formed by means of the subtractive method or the additive method; i.e., low degree of freedom in the design of impedance due to the inability to overlap coils on a single substrate surface.

In the conventional method, difficulty is encountered in regulating the cross-sectional area of spiral coils to more than 0.02 $mm^2$. In contrast, in the present invention, the cross-sectional area of the coils can be selected from a wide range of 0.0003 $mm^2$ to 0.13 $mm^2$ by selecting the diameter of the wire conductor from a range of 0.02 mm to 0.4 mm.

When the wire conductor is an insulation-coated conductor whose surface layer has at least one insulating layer, portions of the wire conductor can be crossed and overlapped with one another, and thus the degree of design freedom is dramatically enhanced, and, as well, impedance setting is readily carried out.

When the wire conductor is a litz wire, even if the cross-sectional area of the conductor is equal to that of a strand wire, flexibility of the conductor is enhanced, and the conductor can be applied to a coil of complicated geometric form. When the wire conductor is flexible, as shown in FIG. 1, which shows an example case where a single strand wire or a litz wire (which have the same cross-sectional area) is applied according to a design of square coil, the wire conductor can be correctly formed into a coil in accordance with the coil design.

When the wire conductor contains at least one species selected from among copper, a copper alloy, aluminum, an aluminum alloy, copper-clad aluminum, a copper-clad aluminum alloy, copper-plated aluminum, and a copper-plated aluminum alloy, the impedance, cross-sectional area, weight, wiring speed, etc. of the conductor can be optimized. In the case where a vibrating diaphragm including coils having the same shape and impedance is designed, for example, when the thickness of the vibrating diaphragm is to be reduced, copper, which has high density, is employed in the wire conductor, whereas when the weight of the vibrating diaphragm is to be reduced, aluminum or an aluminum alloy is employed in the wire conductor.

A second invention of the present invention has been conceived in view of the above-described circumstances. A first object of the second invention is to provide a planer acoustic transducer in which a voice coil provided in a vibrating diaphragm is not prone to wire breakage caused by metal fatigue.

A second object of the second invention is to provide a planer acoustic transducer exhibiting improved midrange sound quality.

In order to achieve the aforementioned objects, the second invention provides a planer acoustic transducer comprising a vibrating diaphragm including a spiral voice coil provided on both surfaces or on one surface of an insulating base film; and a permanent magnet corresponding to the voice coil, wherein at least a portion of the vibrating diaphragm, which portion corresponds to the loop of a first or second vibration mode, is reinforced with a rigidity-imparting member.

FIG. 8(A) shows a model of a vibrating diaphragm 114. This model shows the case where voice coils (2×12 coils) are arranged on a rectangular insulating base film. The first vibration mode of the vibrating diaphragm 114 is shown in FIG. 8(B). Specifically, the center portion of the vibrating diaphragm 114 is the loop of vibration, and this portion exhibits the maximum displacement. In this mode, material strain becomes maximum on broken line x. Meanwhile, in the second vibration mode of the vibrating diaphragm 114, as shown in FIG. 8(C), a node (i.e., a portion where displacement is zero) arises on dash-and-dotted line z which passes through the midpoint of the longitudinal side and runs parallel with the lateral side. In this mode, two loops of vibration arise, and material strain becomes maximum on broken lines x1 and x2, the strain being lower than the maximum strain in the case of the first vibration mode. As used herein, a line which passes along the loop of vibration and runs parallel with the node of the second vibration mode (e.g., line x, x1, or x2 shown in FIG. 8) may be referred to as a "loop ridgeline."

Wire breakage of the voice coil of the vibrating diaphragm, which is caused by metal fatigue, is most likely to occur at a portion corresponding to the loop of the first vibration mode. Therefore, when this portion is reinforced with a rigidity-imparting member, material strain is reduced, and the likelihood of wire breakage can be reduced considerably. The wire breakage is next most likely to occur at a portion corresponding to the loop of the second vibration mode. Therefore, when this portion is also reinforced with a rigidity-imparting member, the likelihood of wire breakage is further reduced. The rigidity-imparting member may be provided so as to cover portions corresponding to both the loop and node of the vibration mode. In the case of the third or higher-order vibration mode, amplitude is smaller than in the case of the first or second vibration mode, and thus the effect of such amplitude on metal fatigue of the voice coil is of a very low degree.

The present inventors have also found that when the rigidity of a portion corresponding to the loop of the first or second vibration mode is enhanced, midrange sound quality is improved.

The pattern of occurrence of the vibration mode varies depending on the shape or material of the vibrating diaphragm. For example, in the case of the rectangular vibrating diaphragm shown in FIG. 8, the vibration mode occurs as described above, whereas in the case of a vibrating diaphragm having a shape other than the aforementioned shape, the vibration mode occurs as described below. Specifically, in the case of a rectangular vibrating diaphragm whose lateral side and longitudinal side have a relatively small difference in length, the first vibration mode is shown in FIG. 9(A), and the second vibration mode is shown in FIGS. 9(B) through 9(D). In the second vibration mode, as shown in FIG. 9(B), a node z which passes through the midpoint of the longitudinal side and runs parallel with the lateral side arises, and, as shown in FIG. 9(C), a node z which passes through the midpoint of the lateral side and runs parallel with the longitudinal side arises. In addition, as shown in FIG. 9(D), a cross-shaped node z arises. In this case, the loop ridgeline is represented by dash-and-dotted line x. In the case of a square vibrating diaphragm, the first vibration mode is shown in FIG. 9(E), and the second vibration mode is shown in FIGS. 9(F) through 9(H). In the second vibration mode, a cross-shaped node z (FIG. 9(F)), an X-shaped node z (FIG. 9(G)), or a rhombus-shaped node z (FIG. 9(H)) arises. Therefore, the loop ridgeline is represented by dash-and-dotted line x. In the case of an elliptic vibrating diaphragm, the first vibration mode is shown in FIG. 10(A), and the second vibration mode is shown in FIGS. 10(B) through 10(F). Similar to the aforementioned cases, in this case, the nodes are represented by broken line x, and the loop ridgeline is represented by dash-and-dotted line z. Regardless of the shape of the vibrating diaphragm, the largest material strain occurs at a portion corresponding to the loop of the first vibration mode, and the second largest material strain occurs at a portion corresponding to the loop of the second vibration mode.

The voice coil of the vibrating diaphragm can be formed through pattern etching of metallic foil applied onto an insulating base film. Alternatively, the voice coil of the vibrating diaphragm may be formed through pattern plating of an insulating base film by means of the additive method. Alternatively, the voice coil of the vibrating diaphragm may be formed by applying, onto an adhesive-applied insulating base film, a copper thin wire, a copper alloy thin wire, an aluminum thin wire, an aluminum alloy thin wire, a copper-clad aluminum thin wire, a copper-clad aluminum alloy thin wire, a copper-plated aluminum thin wire, a copper-plated aluminum alloy thin wire, or a litz wire formed thereof, which wire is coated with an insulating layer.

According to the second invention, the amplitude of vibration, which is attributed to the low-order vibration mode in which large displacement or strain occurs, can be reduced, and divided vibration can be suppressed, thereby attaining improvement of sound quality. In the second invention, a rigidity-imparting member (e.g., a PEN foam member) may be attached onto almost the entire surface (exclusive of edge portions) of the vibrating diaphragm, thereby readily causing piston-like motion, and suppressing divided vibration.

A third invention of the present invention provides a planer acoustic transducer comprising a vibrating diaphragm including a spiral voice coil provided on both surfaces or on one surface of an insulating base film; and a permanent magnet corresponding to the voice coil, wherein the vibrating diaphragm includes a substrate formed of a resin foam.

When the substrate of the vibration diaphragm is a resin foam sheet containing uniform, fine bubbles, which has light weight and high rigidity, as compared with the case where a non-foamed sheet is employed, the entire vibrating diaphragm has light weight and high rigidity, and thus sound quality is improved.

When the vibrating diaphragm employs a uniform-fine-bubble-containing resin foam sheet formed of a resin foam containing bubbles having an average diameter ($\phi$) of 50 μm or less, as compared with the case where a non-foamed sheet is employed, the rigidity of the diaphragm is enhanced, and the weight per unit area of the diaphragm is reduced, which is preferable from the viewpoint of sound quality.

When the vibrating diaphragm employs a resin foam sheet formed of a plurality of foam layers, as compared with the case where a sheet formed of a single foam layer is employed, the rigidity of the diaphragm is enhanced, and sound quality can be further improved.

A fourth invention of the present invention provides a planer acoustic transducer comprising a vibrating diaphragm including a spiral voice coil provided on both surfaces or on one surface of an insulating base film; and a permanent magnet corresponding to the voice coil, wherein the voice coil is formed three-dimensionally. The fourth invention can be applied to any type of vibrating diaphragm, regardless of the method for forming the voice coil.

Examples of the mode of the planer acoustic transducer of the fourth invention include, but are not limited to, a mode in which a portion of the vibrating diaphragm on which the voice coil is provided is folded, and the voice coil assumes a three-dimensional shape.

A fifth invention of the present invention provides a planer acoustic transducer comprising a vibrating diaphragm including a spiral voice coil provided on both surfaces or on one surface of an insulating base film; and a permanent magnet corresponding to the voice coil, wherein the weight (W) of the voice coil preferably accounts for 25% to 75% of the entire weight of the vibrating diaphragm. More preferably, the weight of the voice coil accounts for 40% to 60% of the entire weight of the vibrating diaphragm. This is because, when the weight of the voice coil accounts for less than 25% of the entire weight of the vibrating diaphragm, driving force applied to the voice coil is reduced, and sound pressure fails to increase, whereas when the weight of the voice coil accounts for more than 75% of the entire weight of the vibrating diaphragm, the weight of the entire vibrating diaphragm is also increased, and sound pressure fails to increase.

BEST MODE FOR CARRYING OUT THE INVENTION

An embodiment of the first invention will next be described.

FIRST EMBODIMENT

Figure 1:
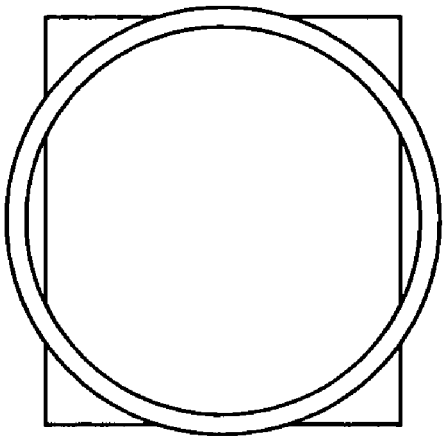
FIG. 1(A) shows the case where a single strand wire is applied according to the design of a square coil.
FIG. 1(B) shows an example of the case where a litz wire having the same cross-sectional area as the strand wire of FIG. 1(A) is applied according to the design of a square coil.
Figure 1:
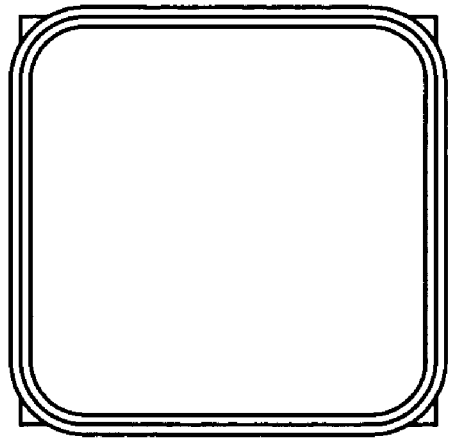
Figure 2:
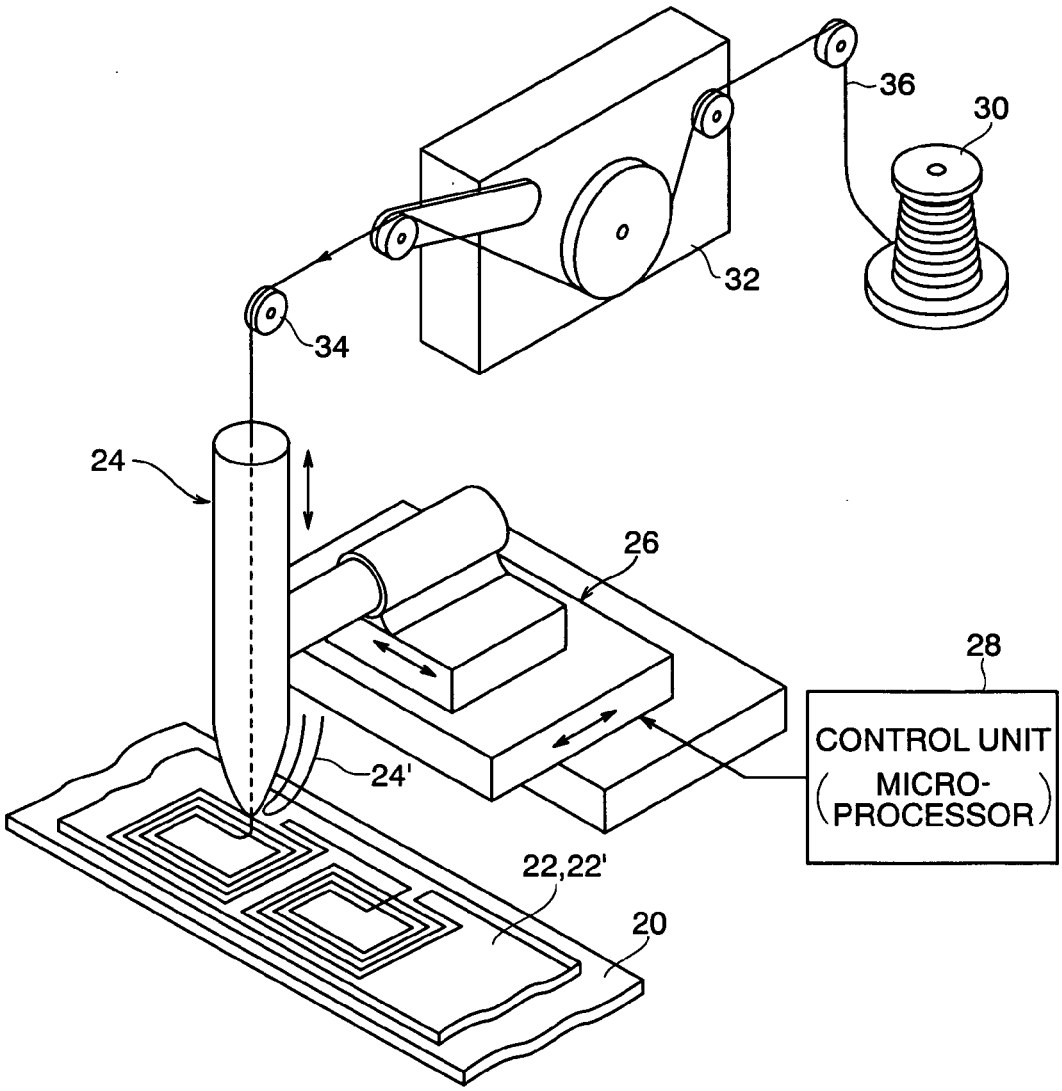
FIG. 2 is a schematic representation showing an exemplary wiring apparatus employed for producing a vibrating diaphragm of the planer acoustic transducer of the first invention.

The wiring apparatus and the wiring method employed in the first invention will now be briefly described with reference to accompanying drawings. As shown in FIG. 2, the wiring apparatus includes a table (conveyer mechanism) 20 on which an adhesive sheet 22 is placed such that its adhesive surface faces upward, and a wiring head 24 which is supported by a moving mechanism (XY table) 26 such that the wiring head can move two-dimensionally with respect to the adhesive sheet. Under control by a control unit 28 including a microprocessor, etc., the moving mechanism 26 causes the wiring head 24 to move two-dimensionally along the surface (adhesive surface) of the adhesive sheet 22, while depicting a predetermined wiring pattern. The wiring head 24 moves vertically in relation to the two-dimensional movement, such that the tip of a nozzle of the wiring head intermittently comes into point contact with the surface of the adhesive sheet 22, whereby a wire conductor 36, which is fed from a bobbin 30 via a tensioner 32, a guide reel 34, etc., is applied onto the surface (adhesive surface) of the adhesive sheet 22 in a sequential manner.

Figure 3:
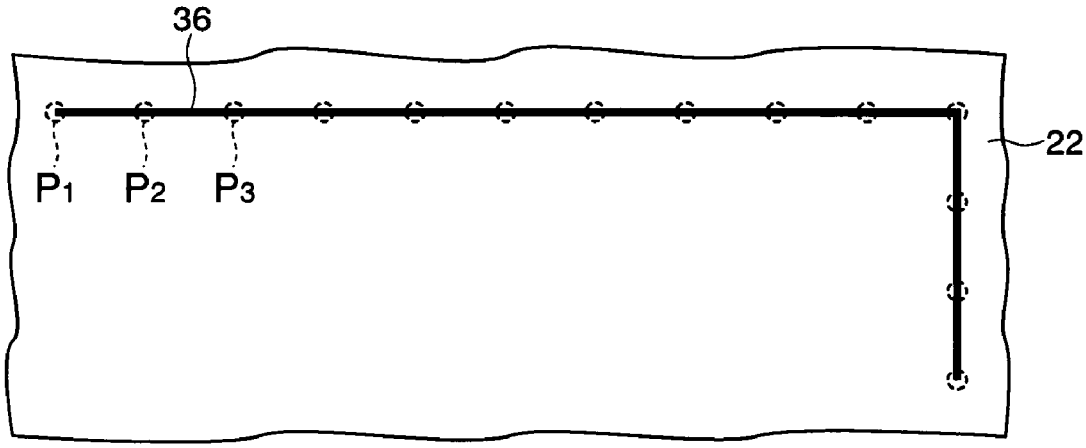
FIG. 3 shows a wiring process employing the wiring apparatus shown in FIG. 2.

Specifically, when the wiring head 24 is lowered, the wire conductor 36 fed from the tip of the head nozzle is instantaneously brought into point contact with the surface of the adhesive sheet 22, and the conductor is attached, at the contact point, onto the surface (adhesive surface) of the adhesive sheet 22. Subsequently, when the wiring head 24 is raised, the wire conductor 36 is pulled out (taken out) of the tip of the head nozzle. Thereafter, by means of the moving mechanism 26, the wiring head is moved a predetermined distance in a predetermined direction along the wiring pattern, and then the wiring head is again lowered, whereby the wire conductor 36 is attached onto the surface (adhesive surface) of the adhesive sheet 22. Thus, by the wiring head 24 which is two-dimensionally moved while being vertically moved, the wire conductor 36 fed from the tip of the nozzle of the wiring head 24 intermittently comes into point contact with the adhesive sheet 22, and, as shown in FIG. 3, the wire conductor 36 is sequentially provided between contact points (P1, P2, P3, etc.), whereby the wire conductor 36 forms the predetermined wiring pattern on the surface (adhesive surface) of the adhesive sheet 22.

Alternatively, an adhesive ejection nozzle 24' may be provided in the vicinity of the wiring head 24, and the wire conductor 36 may be attached onto a non-adhesive sheet 22' (which is to form a vibrating diaphragm) by use of an adhesive which is ejected from the adhesive ejection nozzle 24' immediately before the conductor is applied onto the sheet.

In the vibrating diaphragm of the planer acoustic transducer of the first invention, the adhesive sheet onto which the wire conductor is to be applied in a coil pattern is preferably, for example, a sheet prepared by applying an adhesive or attaching a two-sided adhesive tape onto at least one surface of a sheet-like substrate. Examples of the sheet-like substrate include a variety of polymer films such as polyimide, polyester, liquid crystal polymer, polyphenylene sulfide, nylon, and fully aromatic polyamide (hereinafter referred to as "aramid"); woven or non-woven fabric substrates such as paper, glass cloth, aramid fiber fabric, and aramid fiber non-woven fabric; prepregs prepared by impregnating the woven or non-woven fabric substrates with a thermosetting resin; composite sheets prepared by thermally curing the prepregs; and resin foam sheets prepared through foaming of a resin such as polystyrene, polypropylene, or polyethylene terephthalate. The adhesive sheet to be employed is not limited to the aforementioned preferred examples.

The adhesive sheet may be a heat-resistant film having an adhesive layer on a surface thereof onto which the wire conductor is to be applied. Examples of the heat-resistance film include a film formed of polyethylene naphthalate (PEN). Such a heat-resistant film is produced at low cost, exhibits high heat resistance, and is suitable for the in-vehicle environment, whose temperature tends to become high. In the planer acoustic transducer, since the voice coil is formed on the vibrating diaphragm, Joule heat generated from the voice coil is readily transmitted to the vibrating diaphragm. However, when such a heat-resistant film is employed, degeneration of the vibrating diaphragm, which is caused by the Joule heat, can be suppressed, which is preferable.

The adhesive layer provided on the sheet-like substrate can be formed of an acrylic resin, a silicone resin, or an epoxy resin. A silicone resin or an epoxy resin exhibits high heat resistance, and thus is suitable for the in-vehicle environment. The rigidity of an epoxy resin is enhanced through thermal curing.

After the wire conductor is applied onto predetermined positions of the aforementioned adhesive sheet so as to form the predetermined coil pattern, in order to protect the coil pattern on the adhesive sheet, a sheet-like substrate (e.g., a polymer film, a paper sheet, or a woven or non-woven fabric) may be attached, or an insulating coating material (e.g., a solder resist or a polyimide varnish) may be applied onto the adhesive sheet so as to cover the coil pattern.

When the wire conductor to be applied onto the adhesive sheet is an insulation-coated conductor whose surface layer has at least one insulating layer, a segment of the wire conductor can be overlapped with a segment of the wire conductor which has been applied onto the sheet, thereby increasing the application density of the wire conductor, or segments of the wire conductor can be arbitrarily crossed with one another while being applied onto the sheet, whereby the sound conversion efficiency of the vibrating diaphragm can be enhanced, as well as the degree of freedom in the design of the shape or impedance can be enhanced, which is preferable.

Figure 7:
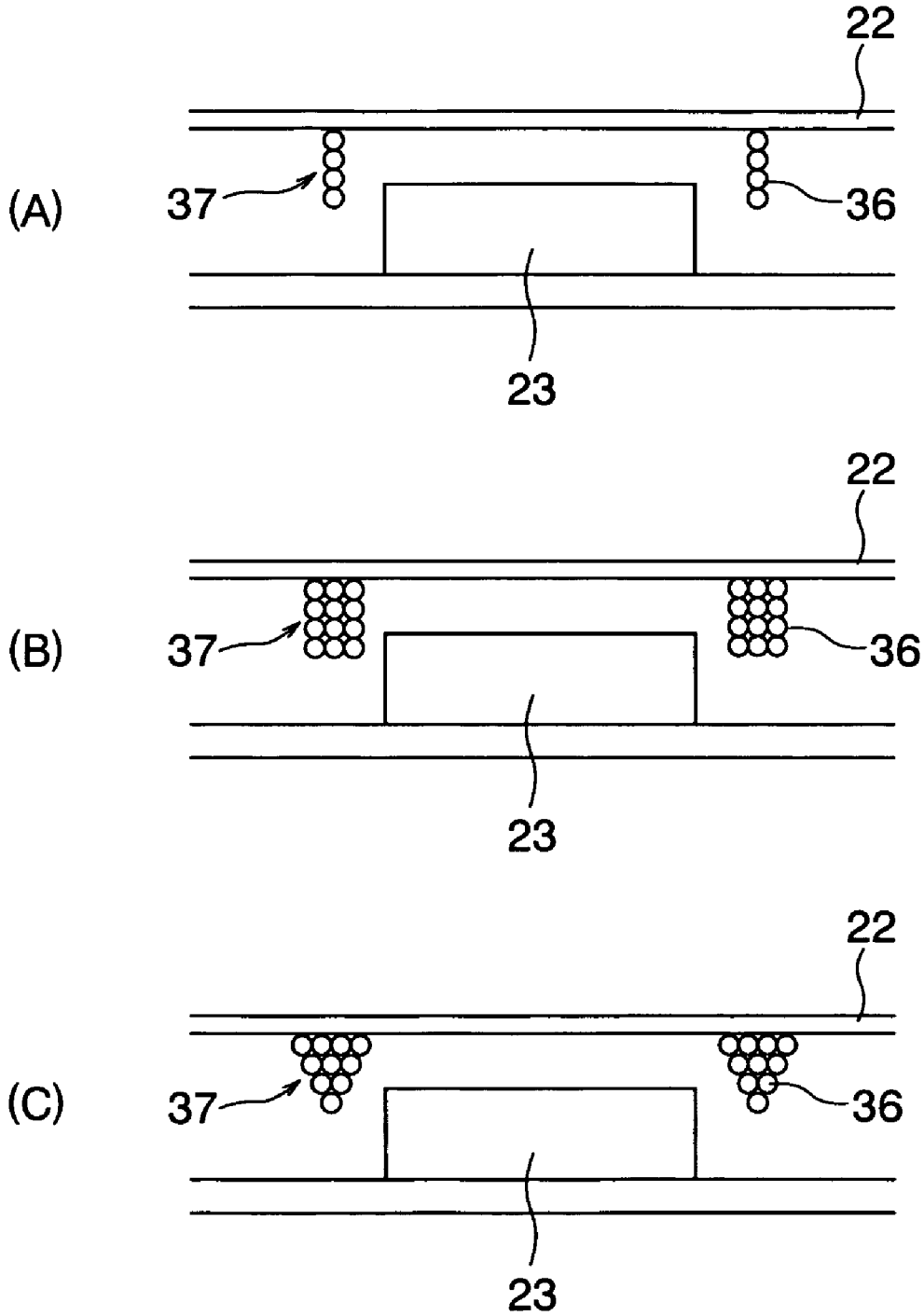
FIG. 7 is a schematic representation showing an example of a spiral coil.
Figure 8:
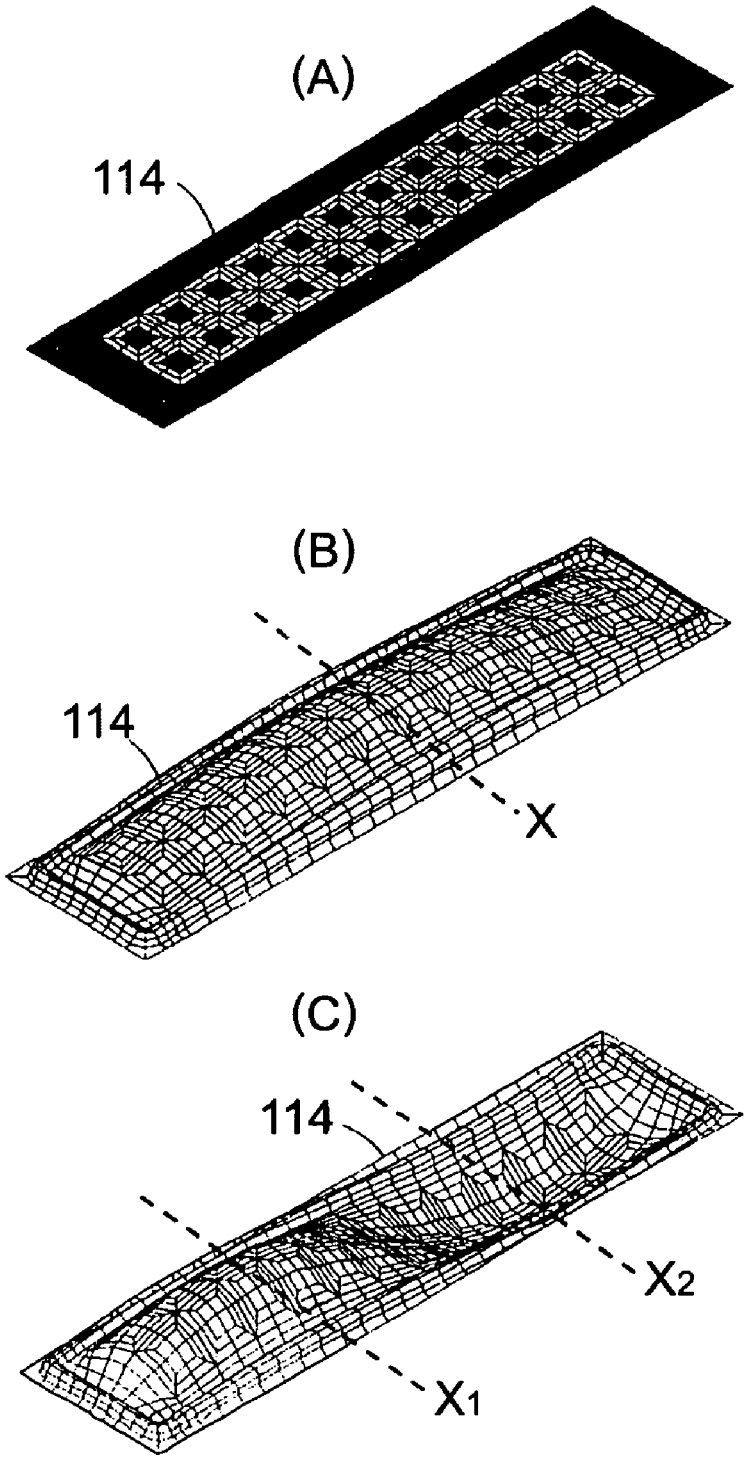
FIG. 8(A) is a perspective view showing a model of a vibrating diaphragm for a planer acoustic transducer.
FIG. 8(B) is a perspective view showing the first vibration mode of the vibrating diaphragm.
FIG. 8(C) is a perspective view showing the second vibration mode of the vibrating diaphragm.
Figure 9:
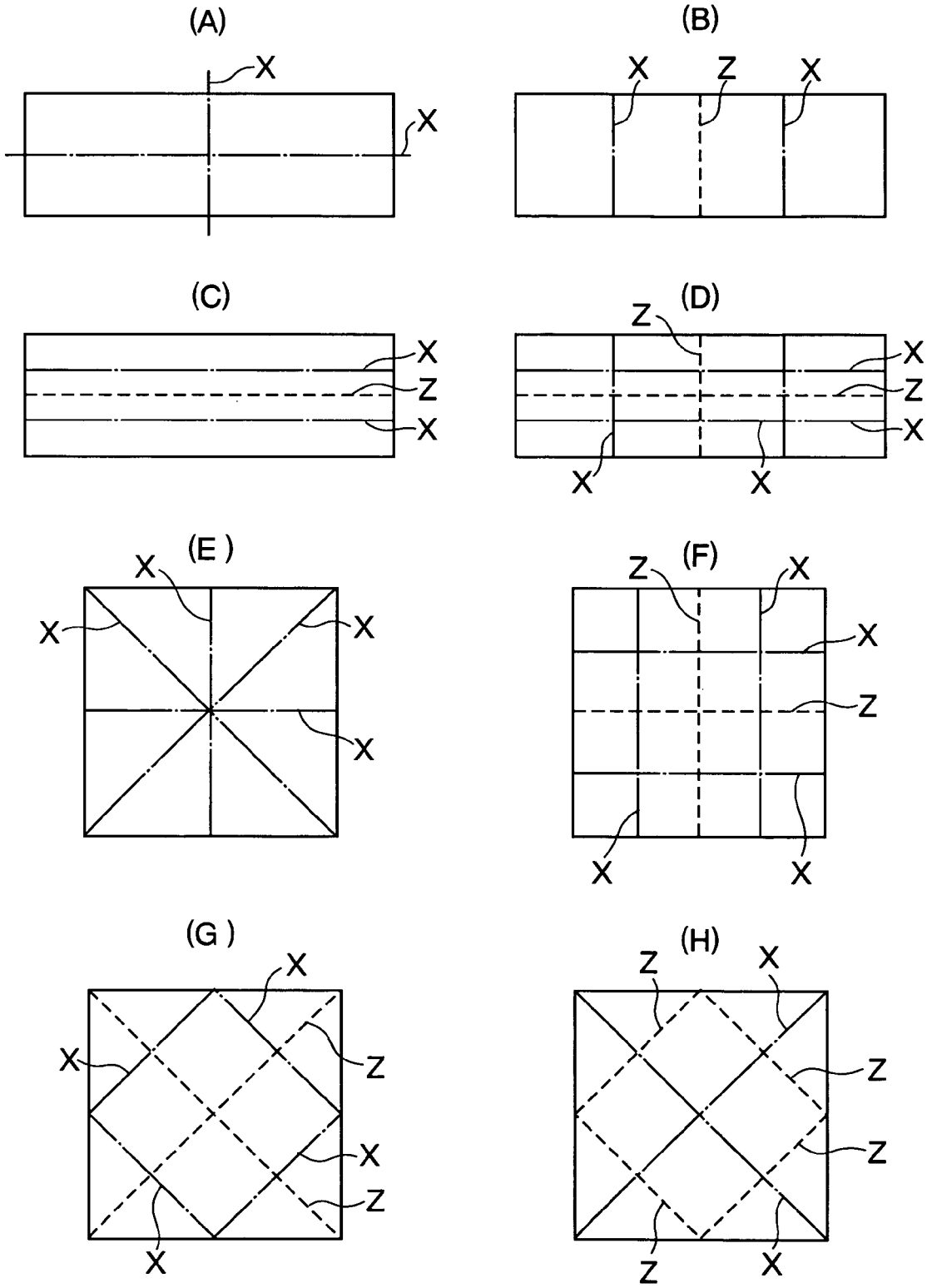
FIG. 9(A) shows the first vibration mode of a rectangular vibrating diaphragm.
FIGS. 9(B), 9(C), and 9(D) show the second vibration mode of the rectangular vibrating diaphragm.
FIG. 9(E) shows the first vibration mode, of a square vibrating diaphragm.
FIGS. 9(F), 9(G), and 9(H) show the second vibration mode of the square vibrating diaphragm.
Figure 10:
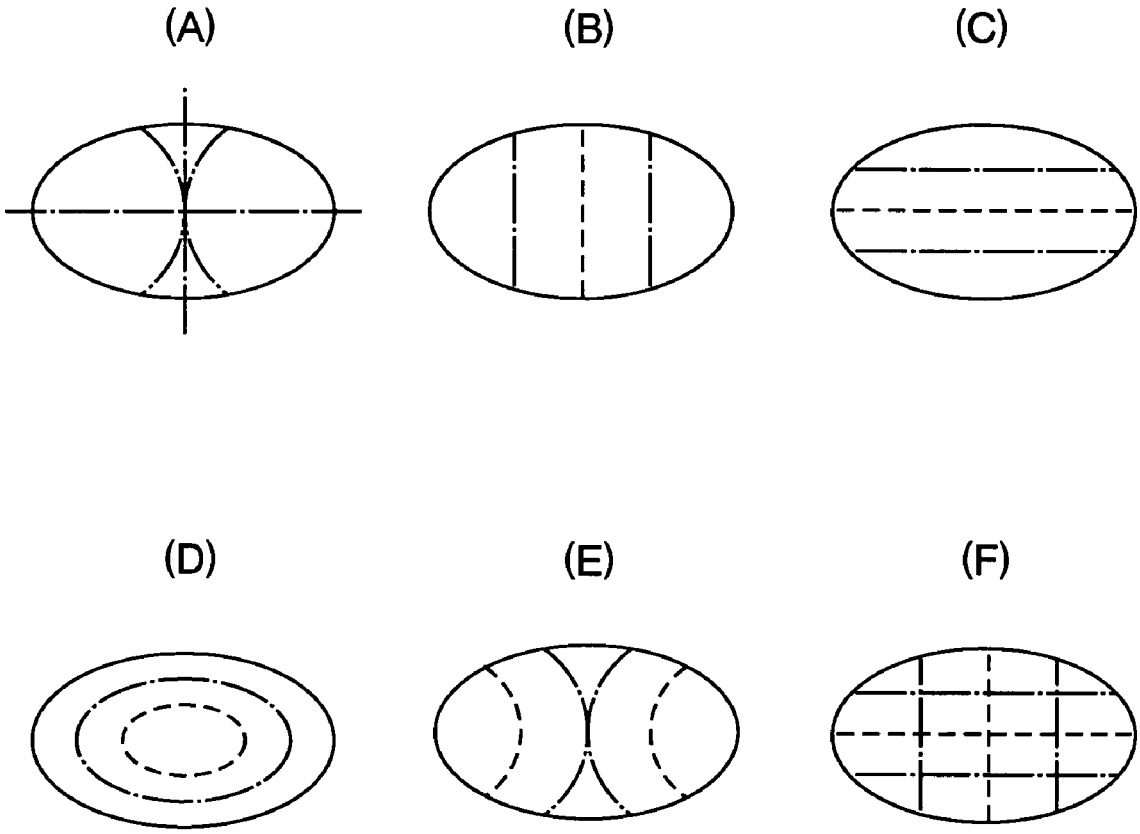
FIG. 10(A) shows the first vibration mode of an elliptic vibrating diaphragm.
FIGS. 10(B), 10(C), 10(D), 10(E), and 10(F) show the second vibration mode of the elliptic vibrating diaphragm.

As shown in FIGS. 7(A), 7(B), and 7(C), the vibrating diaphragm may include a spiral coil 37 which is formed by applying the wire conductor 36 onto the surface of the adhesive sheet 22 that faces a magnet 23 such that a plurality of coil segments are stacked in a thickness direction of the vibrating diaphragm. In this case, the wire conductor 36 preferably has an insulating layer on its surface, from the viewpoint of prevention of electrical conduction between the coil segments formed of the conductor 36. Meanwhile, the coil segments formed of the wire conductor 36 may be bonded together by use of an adhesive for maintaining the stacked state. With this configuration, while the distance between the coil and the magnet is reduced (the coil is caused to exist in a region of high magnetic flux density), large displacement of the vibrating diaphragm is allowed to occur, whereby sound characteristics (in particular, bass characteristics) of the planer acoustic transducer can be improved. In addition, when low-frequency output is high; i.e., when amplitude is large, the vibrating diaphragm tends not to collide with the magnet, and the maximum input applicable to the coil increases. In the case of the conventional planer acoustic transducer, since the vibrating diaphragm tends to collide with the magnet, high-output reproduction fails to be attained, although bass reproduction can be attained.

When wiring of the wire conductor is carried out by use of the wiring apparatus, the wire conductor is required to have predetermined strength and flexibility. When the wire conductor has flexibility, the wire conductor accurately follows the movement of the wiring head, and the conductor can be correctly formed into a coil in accordance with the design of the coil. In general, when the cross-sectional area of the wire conductor is large, the rigidity of the conductor increases, which makes it difficult to apply the conductor in a sharp pattern to form a sharp-angled shape. Meanwhile, when the diameter of the wire conductor is smaller than 0.02 mm, the tensile strength of the conductor is lowered, and thus wire breakage of the conductor occurs during wiring, leading to difficulty in high-speed wiring, whereas when the diameter of the wire conductor is 0.4 mm or more, the rigidity of the conductor increases, but a limitation is imposed on the movement of the wiring head, and difficulty is encountered in operating the wiring apparatus at high speed, as well as difficulty is encountered in forming a coil from the conductor in accordance with the design of the coil. Particularly, when the diameter of the wire conductor is increased, difficulty is encountered in forming a sharp-angled coil from the conductor. However, increasing the diameter of the wire conductor; i.e., increasing the cross-sectional area of the conductor, is advantageous in that the maximum input applicable to the resultant voice coil increases, and Joule heat radiation efficiency is enhanced. In order to utilize such advantages, preferably, a litz wire is employed as the wire conductor so that the conductor has large cross-sectional area and flexibility.

In the planer acoustic transducer of the first invention, preferably, the wire conductor applied onto the vibrating diaphragm is connected to a terminal by use of a tinsel wire. When a tinsel wire is employed as a lead wire, wire breakage does not occur, and reliability is enhanced.

In the case where a tinsel wire is employed, preferably, the wire conductor applied onto the vibrating diaphragm is connected to the tinsel wire through soldering, and the solder-connected portion is coated with a resin. When the wire conductor is exposed at the solder-connected portion, vibration of the vibrating diaphragm may lead to fatigue and breakage of the conductor. However, when the solder-connected portion is coated with a resin, breakage of the wire conductor is reliably prevented, whereby reliability can be further enhanced.

Embodiments of the second invention will next be described.

SECOND EMBODIMENT

Figure 11:
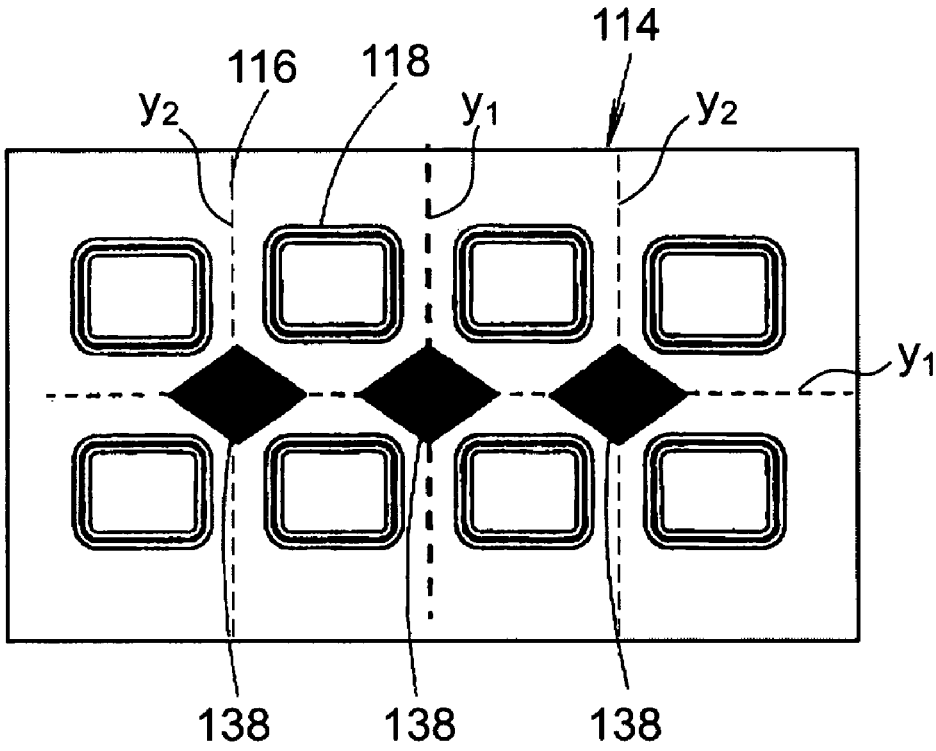
FIG. 11 is an explanatory view showing an embodiment of the second invention.

FIG. 11 shows an embodiment of the second invention. FIG. 11 shows merely a vibrating diaphragm 114, and other components constituting the planer acoustic transducer are similar to those of a conventional planer acoustic transducer (the same shall apply in the below-described embodiments). The vibrating diaphragm 114 includes an insulating base film 116, voice coils 118 (2×4 coils) formed on both surfaces or on one surface of the base film, and rhombic, island-like patterns 138 provided on portions of the base film that correspond to the loops of the first and second vibration modes, the patterns serving as a rigidity-imparting member.

In FIG. 11, y1 denotes a ridgeline which passes along the loop of the first vibration mode, and y2 denotes a ridgeline which passes along the loop of the second vibration mode.

In the case where the voice coils 118 are formed through etching of a metallic foil applied onto the insulating base film 116; i.e., the voice coils are formed by means of the subtractive method, the island-like patterns 138 are formed by portions of the metallic foil that have not been etched. Meanwhile, in the case where the voice coils 118 are formed through pattern plating; i.e., the voice coils are formed by means of the additive method, the island-like patterns 138 are formed together with the voice coils 118 through plating. In each case, formation of the island-like patterns 138 does not require an additional process, which leads to excellent mass productivity and reduction of production cost.

When the aforementioned island-like patterns 138 are formed, portions of the vibrating diaphragm that correspond to the loops of the first and second vibration modes exhibit enhanced rigidity. Therefore, material strain is reduced at the portions, and wire breakage of the voice coils 118 (including breakage of a wire for connecting the voice coils) can be reduced (improvement of sound quality will be described in Examples).

THIRD EMBODIMENT

Figure 12:
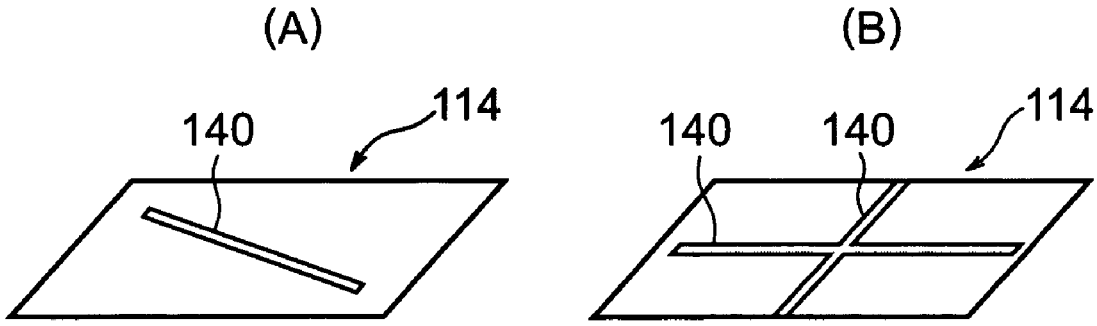
FIGS. 12(A) and 12(B) are explanatory views showing another embodiment of the second invention.

FIGS. 12(A) and 12(B) show another embodiment of the second invention. In this embodiment, a rib 140 serving as a rigidity-imparting member is attached onto a vibrating diaphragm 114. The rib 140 is attached so as to pass through at least a portion of the vibrating diaphragm 114 that corresponds to the loop of the first or second vibration mode. Preferably, the rib 140 is formed of a material having light weight and exhibiting higher rigidity than that of the insulating base film 116, such as paper, resin, resin foam, metal, wood, thermosetting-resin-impregnated non-woven fabric, or porous ceramic.

The third embodiment can be applied to the case where the voice coil is formed by means of the subtractive method or the additive method, as well as the case where the voice coil is formed of a metallic thin wire coated with an insulating layer.

FOURTH EMBODIMENT

Figure 13:
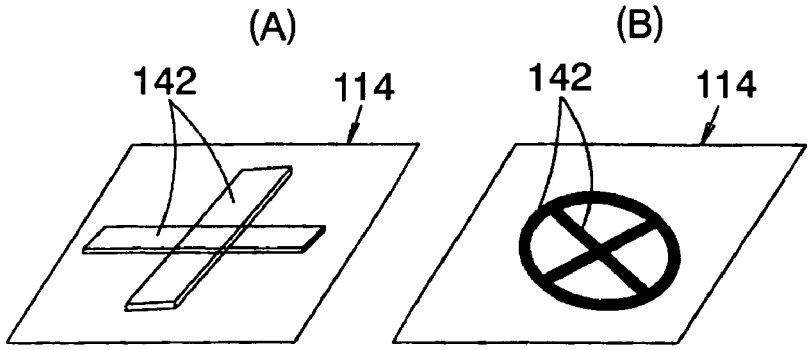
FIGS. 13(A) and 13(B) are explanatory views showing yet another embodiment of the second invention.
Figure 14:
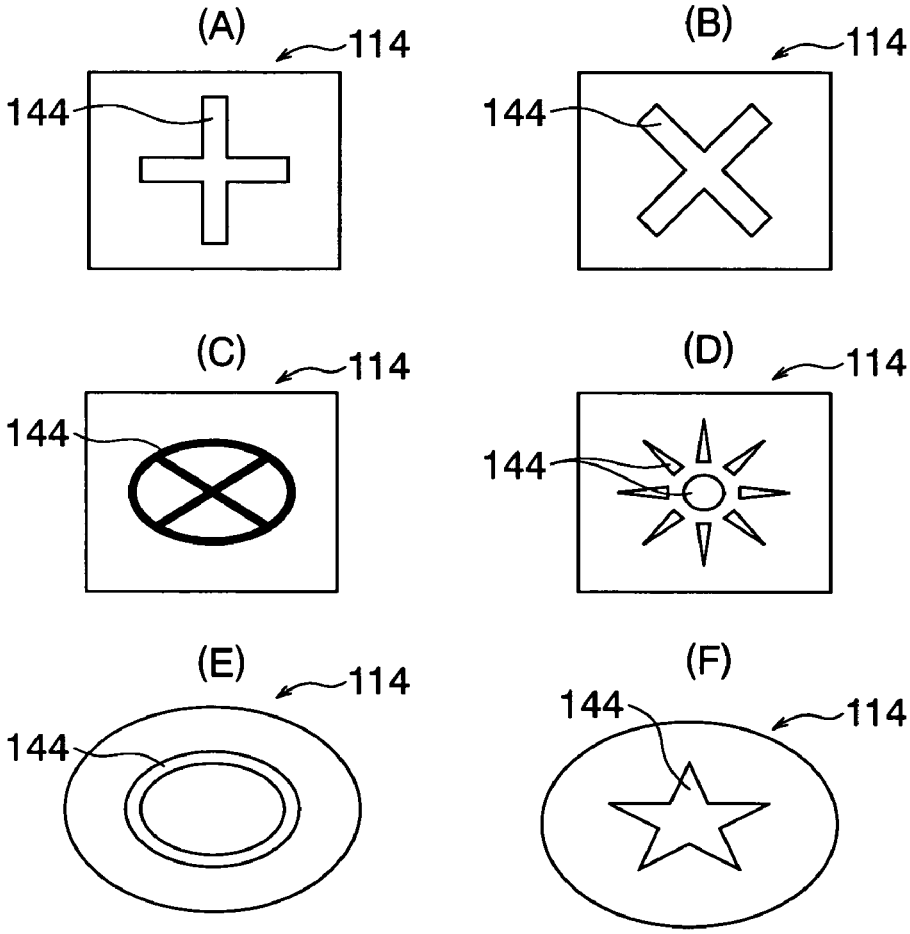
FIGS. 14(A) through 14(F) are explanatory views showing still another embodiment of the second invention.

FIGS. 13(A) and 13(B) show yet another embodiment of the second invention. In this embodiment, a foam member 142 serving as a rigidity-imparting member is attached onto a vibrating diaphragm 114. No particular limitations are imposed on the shape of the foam member 142, so long as it covers at least a portion of the vibrating diaphragm 114 that corresponds to the loop of the first or second vibration mode. When the weight of the entire vibrating diaphragm increases, the motion performance of the diaphragm tends to be lowered. Meanwhile, so long as the foam member 142 is attached so as to cover the portion corresponding to the loop of the vibration mode, the foam member exhibits sufficient effects. Therefore, in some cases, preferably, the foam member 142 is attached so as not to cover the entire surface of the vibrating diaphragm.

Similar to the third embodiment, the fourth embodiment can be applied to the case where the voice coil is formed by means of the subtractive method or the additive method, as well as the case where the voice coil is formed of a metallic thin wire coated with an insulating layer.

FIFTH EMBODIMENT

FIGS. 14(A) through 14(F) show still another embodiment of the second invention. In this embodiment, a thermosetting resin 144 serving as a rigidity-imparting member is applied onto a vibrating diaphragm 114, and then thermally cured. This embodiment can be applied to any type of vibrating diaphragm, regardless of the method for forming a voice coil. The thermosetting resin 144 may be applied onto the entire surface of the vibrating diaphragm 114. However, when the thermosetting resin is applied onto the entire surface of the vibrating diaphragm, the weight of the entire diaphragm increases, and sound pressure is lowered at a high frequency range of 5 kHz or more. Therefore, preferably, only when the vibrating diaphragm is designed for producing a midrange or bass planer acoustic transducer, the thermosetting resin may be applied onto the entire surface of the diaphragm. When the weight of the vibrating diaphragm 114 increases as a result of application of the thermosetting resin 144, sound pressure may be lowered, or the frequency band may shift toward the low frequency side. Therefore, in some cases, preferably, application of the thermosetting resin 144 is restricted to a minimum necessary area including the portion corresponding to the loop of the first or second vibration mode. FIGS. 14(A) through 14(F) show examples of application patterns of the thermosetting resin 144.

More preferably, the thermosetting resin 144 contains a filler such as silica, calcium carbonate, or barium sulfate. Incorporation of such a filler is effective for enhancing the rigidity of the resin after curing thereof, or for enabling thick application of the resin. The filler-containing thermosetting resin 144 may employ, as a resin base, an epoxy resin, a melamine resin, a silicone resin, an alkyd resin, or the like.

The thermosetting resin 144 preferably has a thickness of 10 to 200 μm, from the viewpoint of sound characteristics. When the thickness of the thermosetting resin 144 is less than 10 μm, the resin insufficiently contributes to enhancement of rigidity. In general, rigidity increases in proportion to the cube of the thickness. When the thickness of the thermosetting resin 144 exceeds 200 μm, the weight of the vibrating diaphragm increases, and thus sound pressure is lowered, or resonance frequency is lowered, which are undesirable. The thermosetting resin 144 is optimally a foamable thermosetting resin, since it enables enhancement of rigidity by increasing the thickness, and attains weight reduction.

When a filler is added to the thermosetting resin for the purpose of enhancement of rigidity, preferably, the filler assumes a spherical shape or a virtually spherical, undefined shape. Employment of a filler having a pointed shape may cause cracking during vibration of the vibrating diaphragm, leading to exfoliation of the thermosetting resin. Hollow, micro spheres formed of foam glass are preferably employed as a filler, since such a filler exhibits high rigidity enhancement effect and has light weight.

SIXTH EMBODIMENT

FIGS. 26 through 32 show yet another embodiment of the second invention. In this embodiment, a rigidity-imparting member is formed of voice coils 118 provided on a vibrating diaphragm 114. In this embodiment, the voice coils are arranged such that the rigidity of the vibrating diaphragm is appropriately regulated by means of the rigidity of the coils.

Similar to the aforementioned embodiments, this embodiment can be applied to any type of vibrating diaphragm, regardless of the method for forming a voice coil.

Figure 27:
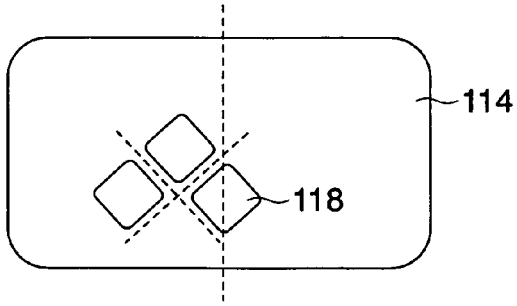
FIG. 27 is an explanatory view showing an embodiment of the second invention.
Figure 28:
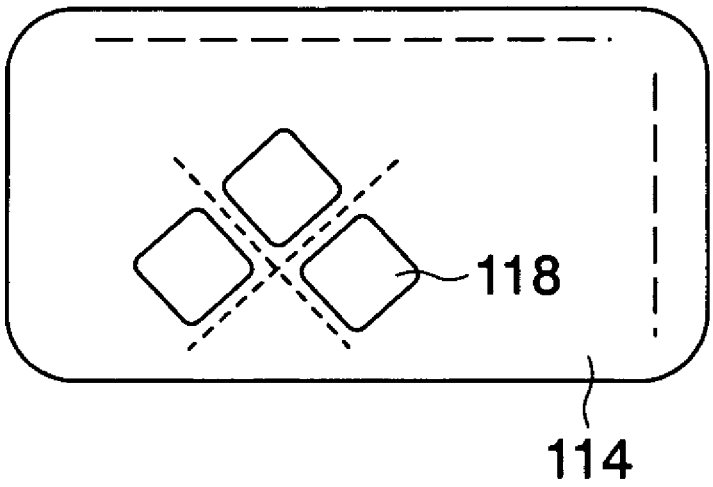
FIG. 28 is an explanatory view showing an embodiment of the second invention.
Figure 29:
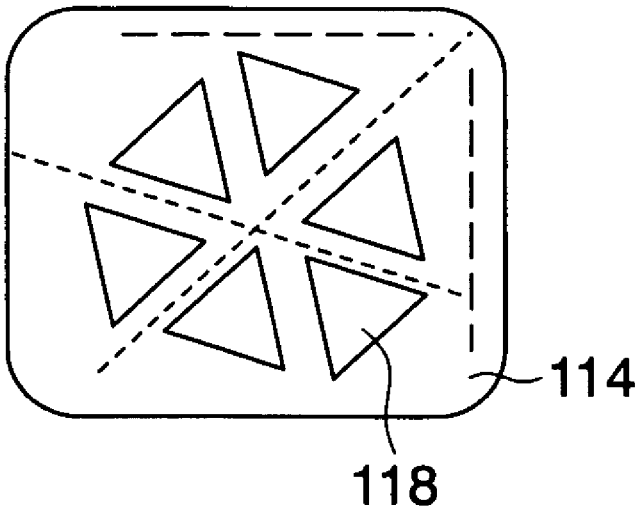
FIG. 29 is an explanatory view showing an embodiment of the second invention.

In the case where voice coils are formed on a portion of a vibrating diaphragm so as to reinforce the diaphragm, which portion corresponds to the loop of the low-order vibration mode of a vibrating diaphragm having no voice coil, the portion corresponding to the loop of the low-order vibration mode may shift to the vicinity of the outer peripheries of the voice coils formed on the vibrating diaphragm. In such a case, preferably, as shown in FIG. 26(A), voice coils are arranged on a virtually rectangular vibrating diaphragm such that the voice coils forms a staggered pattern; specifically, the rigidity-imparting member is formed by the voice coils 118 provided on the vibrating diaphragm 114, and additional voice coils are provided in the vicinity of at least a portion 160 of the vibrating diaphragm 114, which portion corresponds to the loop of the first or second vibration mode, such that the additional voice coils do not overlap with the loop-corresponding portion 160; or, as shown in FIG. 26(B), the rigidity-imparting member is formed by a plurality of the voice coils 118 provided on the vibrating diaphragm 114, and the voice coils 118 are arranged on the loop-corresponding portion 160 at different positions with respect to the loop. Alternatively and preferably, as shown in FIG. 27, the rigidity-imparting member is formed by the voice coils 118 provided on the vibrating diaphragm 114, each of the voice coils 118 having straight portions, and the voice coils 118 are arranged such that the straight portions of each voice coil are not in parallel with a ridge line of the loop-corresponding portion 160 (e.g., the voice coils are arranged in a rhombic pattern); or, as shown in FIGS. 28 and 29, the rigidity-imparting member is formed by the voice coils 118 provided on the vibrating diaphragm 114, each of the voice coils 118 assumes a rectangular or triangular shape and has straight portions, the vibrating diaphragm 114 assumes a virtually rectangular shape and has straight portions, and the voice coils 118 are arranged such that the straight portions of each voice coil are not in parallel with the straight portions of the vibrating diaphragm 114.

Figure 30:
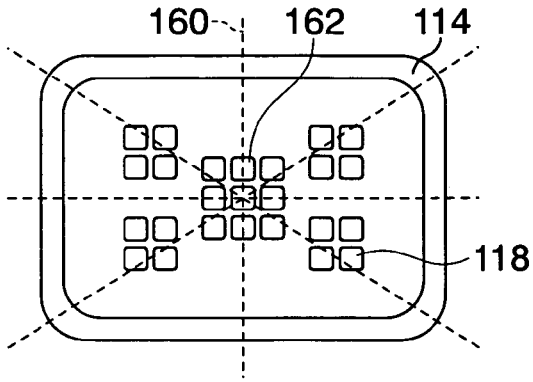
FIG. 30 is an explanatory view showing an embodiment of the second invention.
Figure 31:
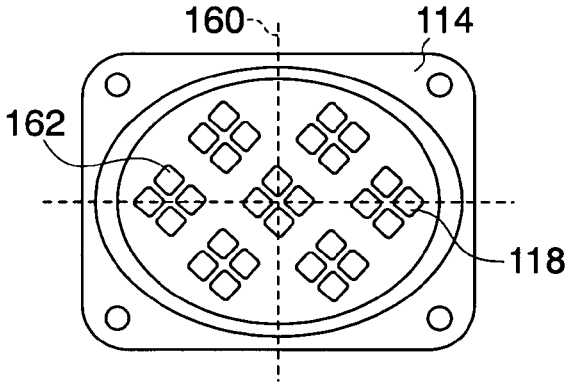
FIG. 31 is an explanatory view showing an embodiment of the second invention.
Figure 32:
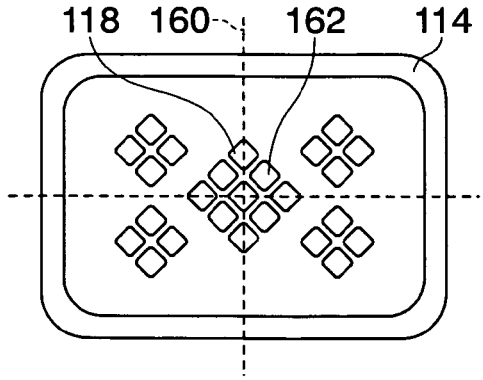
FIG. 32 is an explanatory view showing an embodiment of the second invention.

In the case where the size of a vibrating diaphragm is larger than that of a voice coil, a voice coil unit consisting of a plurality of voice coils which are arranged close to one another may be provided on a portion of the vibrating diaphragm that corresponds to the loop of the low-order vibration mode. For example, as shown in FIGS. 30 through 32, voice coil units 162, each consisting of voice coils (2×2 coils or 3×3 coils), may be arranged on a portion 160 of a vibrating diaphragm that corresponds to the loop of the low-order vibration mode.

An embodiment of the third invention will next be described.

SEVENTH EMBODIMENT

The third invention can be applied to any type of vibrating diaphragm, regardless of the method for forming a voice coil. This embodiment describes the case where a coil is formed by means of the wiring method.

In this embodiment, a wire conductor is applied onto the aforementioned adhesive sheet so as to form a predetermined coil pattern at a predetermined position, and subsequently, a resin foam sheet containing uniform, fine bubbles is attached onto the adhesive sheet so as to cover the coil pattern, in order to protect the coil pattern on the adhesive sheet, as well as to enhance the rigidity of the sheet, which is to become a vibrating diaphragm. When the resin foam sheet is employed in a planer acoustic transducer diaphragm, in consideration of the thickness of the resin foam sheet, preferably, the sheet contains more uniform, fine bubbles. Therefore, the average diameter (ϕ) of bubbles contained in the resin foam sheet is preferably 50 μm or less, more preferably 10 μm or less, particularly preferably 5 μm or less. No particular limitations are imposed on the thickness of the resin foam sheet, but, in consideration of sound pressure characteristics and rigidity, the thickness is preferably 1 mm or less, more preferably 0.7 mm or less. The expansion ratio of the resin foam sheet is preferably high, from the viewpoint of weight reduction. In consideration of the sheet thickness and the bubble diameter, the expansion ratio is more preferably about 4 to about 8.

Next will be described in more detail the method for producing a resin foam sheet containing uniform, fine bubbles, which is employed in the third invention. Firstly, a resin molded product which has not yet been foamed is sealed in a high-pressure container, and an inert gas (preferably carbon dioxide gas) is injected into the container, thereby permeating the inert gas (preferably carbon dioxide gas) into the non-foamed resin molded product. No particular limitations are imposed on the pressure of the inert gas and the time required for the permeation. However, preferably, when the inert gas pressure is high, the permeation is carried out for a short period of time, whereas when the inert gas pressure is low, the permeation is carried out for a long period of time. After the inert gas (preferably carbon dioxide gas) is sufficiently permeated into the resin molded product as described above, the pressure is released from the container, and the gas-permeated resin molded product is removed from the container and then heated, thereby foaming the product. The heating temperature during foaming is regulated to a temperature equal to or higher than the foaming initiation temperature. No particular limitations are imposed on the heating means, and the heating means is selected in consideration of the characteristics of a foam sheet to be formed. For example, when the resin molded product is quickly heated, oil, etc. is employed as the heating means, whereas when the molded product is gradually heated, an air oven, etc. is employed as the heating means. Heating of the resin molded product is carried out for a period of time required for completion of bubble growth. For example, when the resin molded product has a thickness of about 0.5 mm, the heating time is preferably 60 seconds or thereabouts. After being heated, the resin molded product is cooled, to thereby yield a foam sheet. The term "foaming initiation temperature" as used in the third invention refers to the temperature at which the expansion ratio exceeds 1.1.

According to the above-described method, when an inert gas (preferably carbon dioxide gas) is employed, and the heating temperature during foaming is regulated to a temperature equal to or higher than the foaming initiation temperature, there can be produced a resin foam sheet containing uniform, fine bubbles, having light weight, and exhibiting high mechanical strength and surface smoothness.

The resin molded product which is to be foamed into the resin foam sheet employed in the third invention may be formed of a single layer or multiple layers (i.e., two or more layers). For example, when a resin layer capable of being highly foamed through the aforementioned foaming process is previously incorporated as an intermediate layer into the resin molded product, the weight of the resultant resin foam sheet can be reduced. No particular limitations are imposed on the resin species constituting the multiple layers of the resin molded product, and the resin species may be identical to or different from one another. However, preferably, the resin molded product is formed of layers prepared from a single resin species by use of a production apparatus such as a multi-layer extruder or a multi-layer injection molding machine, in consideration of, for example, dimension stability, and exfoliation of the layers, which would occur due to the difference in thermal deformation between the layers when the resin molded product is heated through the foaming or postforming process. In this case, no particular limitations are imposed on the method for producing the resin molded product formed of the layers.

No particular limitations are imposed on the type of resin employed in the third invention, so long as the third invention can be realized through use of the resin. However, generally, a thermoplastic resin is preferably employed. Examples of the thermoplastic resin include polypropylene, polycarbonate, polymethylene methacrylate, polyethylene terephthalate, polyphenyl sulfide, polyphenylene sulfide, polyethylene naphthalate (hereinafter abbreviated as "PEN"), polybutylene terephthalate, polycyclohexane terephthalate, poly-1,4-cyclohexanedimethylene terephthalate, polybutyne naphthalate, polyetherimide, polyethersulfone, and polysulfone. The thermoplastic resin may be a cyclic polyolefin-based resin. Particularly, a saturated cyclic olefin-based resin, which exhibits excellent long-term durability, is preferred. Particularly, a thermoplastic polyester resin is preferably employed. A thermoplastic polyester resin has the following advantages: the resin mitigates a trough of sound pressure within a midrange; the resin exhibits high heat resistance even when being close to a wire conductor; and the resin has light weight and high rigidity. A resin alloy formed of a mixture of different thermoplastic resin species may be employed, so long as the third invention can be realized through use of the resin alloy.

The aforementioned thermoplastic resin serving as a raw material may contain an additive such as a bubble-nucleating agent, an antioxidant, an antistatic agent, a UV absorbing agent, a light stabilizer, a pigment, or a lubricant, so long as such an additive does not affect the mechanical strength and foamability of the resin. The amount of such an additive incorporated into the resin is determined in consideration of characteristics of the resultant final product, and is preferably 5 wt. % or less. According to this embodiment, an increase in the weight of a vibrating diaphragm is minimized, and the rigidity of the vibrating diaphragm can be enhanced. Therefore, even when this embodiment is applied to a planer acoustic transducer including a vibrating diaphragm having large area, deterioration of sound quality, which occurs when the vibrating diaphragm deflects under its own weight and comes into contact with a magnet, can be reduced.

EIGHTH EMBODIMENT

Another embodiment of the third invention will next be described. This embodiment can also be applied to any type of vibrating diaphragm, regardless of the method for forming a voice coil. This embodiment also describes the case where a coil is formed by means of the wiring method.

In this embodiment, an adhesive is applied onto such a resin foam sheet as employed in the seventh embodiment, thereby preparing an adhesive sheet, and a wire conductor is applied onto the adhesive sheet so as to form a predetermined coil pattern at a predetermined position, to thereby produce a vibrating diaphragm. According to this embodiment, a vibrating diaphragm having light weight and high rigidity can be produced. Thus, even when this embodiment is applied to a planer acoustic transducer including a vibrating diaphragm having large area, deterioration of sound quality, which occurs when the vibrating diaphragm deflects under its own weight and comes into contact with a magnet, can be reduced.

NINTH EMBODIMENT

Figure 38:
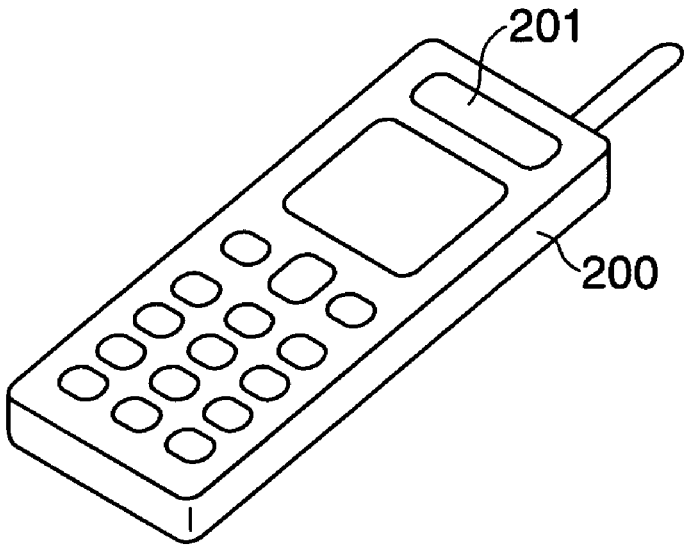
FIG. 38 is a schematic representation showing a cellular phone including a planer acoustic transducer.

In this embodiment, the aforementioned planer acoustic transducer is applied to a portable electronic device such as a cellular phone or an information terminal. As shown in FIG. 38, a cellular phone 200 includes a planer acoustic transducer 201 serving as a planer acoustic transducer for phone call. Since the planer acoustic transducer 201 can be formed to have a small thickness, and has high degree of freedom in the design of shape, the degree of freedom in the arrangement of the planer acoustic transducer on the cellular phone 200 is increased. Thus, the planer acoustic transducer meets the requirements for miniaturization and weight reduction of a portable electronic device such as a cellular phone or an information terminal, and therefore a preferred portable electronic device can be produced from the planer acoustic transducer. Since having high degree of freedom in arrangement, the planer acoustic transducer 201 of relatively large size and high output can be arranged in a limited space. In addition, since the planer acoustic transducer can provide high sound volume, it is suitable for use in a handsfree cellular phone. Furthermore, incorporation of the planer acoustic transducer into a portable electronic device enables listening to sound from the device with watching the display of the device.

TENTH EMBODIMENT

Figure 39:
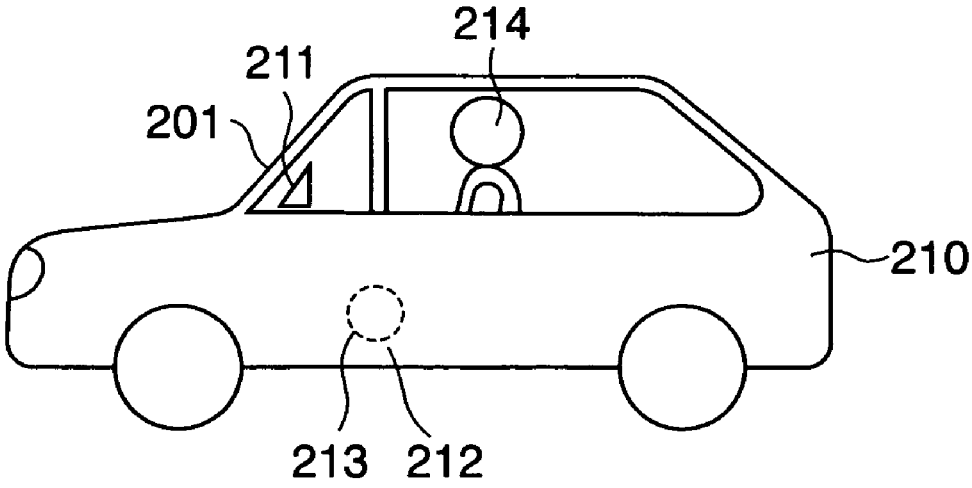
FIG. 39 is a schematic representation showing an automobile including a planer acoustic transducer.
Figure 40:
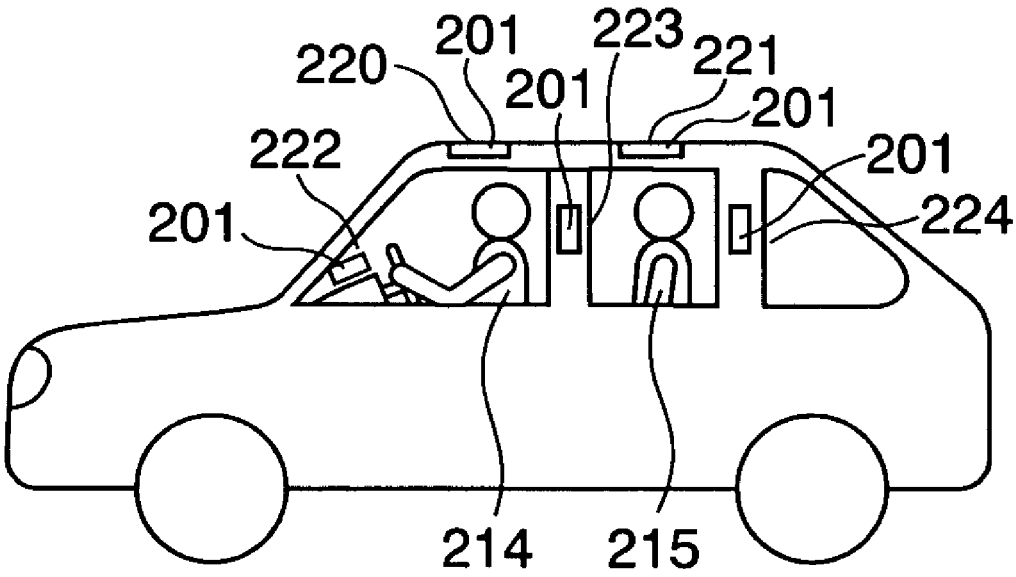
FIG. 40 is a schematic representation showing an automobile including planer acoustic transducers.

In this embodiment, the aforementioned planer acoustic transducer is applied to an automobile. An automobile 210 shown in FIG. 39 includes a door frame garnish section 211, and a virtually triangular planer acoustic transducer 201 mounted thereon, the planer acoustic transducer serving as an audio planer acoustic transducer which reproduces sound of mid/high-frequency range. Since the planer acoustic transducer 201 can be formed to have a small thickness, and has high degree of freedom in the design of shape, the planer acoustic transducer can be mounted on the door frame garnish section 211, which has conventionally been considered a dead space and has limited the planer acoustic transducer that can be mounted thereon to a tweeter. According to this embodiment, a door planer acoustic transducer 213, which has conventionally been mounted in, for example, a lower section 212 of the interior of the door, can be eliminated, and the lower section 212 can be effectively used as, for example, a storage space. In the case where the planer acoustic transducer 201 is provided on the door frame garnish section 211, since no obstacles are present between the planer acoustic transducer and a passenger 214, the planer acoustic transducer can provide the passenger 214 with high-quality sound, without producing muffled sound and reducing the sound level in the high-frequency range.

ELEVENTH EMBODIMENT

Similar to the tenth embodiment, in this embodiment, the aforementioned planer acoustic transducer is applied to an automobile. An automobile 210 includes a front roof section 220, a rear roof section 221, a dashboard 222, a center pillar 223, and a rear pillar 224, each of these parts having a planer acoustic transducer 201. Since the planer acoustic transducer 201 can be formed to have a small thickness, and has high degree of freedom in the design of shape, the planer acoustic transducer can be mounted on a part which has conventionally failed to have a planer acoustic transducer. Therefore, a good sound field can be provided to passengers 214 and 215. Since the planer acoustic transducer 201 has a weight lighter than that of a conventional cone planer acoustic transducer, even when the number of the planer acoustic transducer provided in a vehicle is increased, an increase in the weight of the vehicle can be suppressed. With the above-described characteristic features, the planer acoustic transducer is suitable for producing an in-vehicle sound system of multiple channels (e.g., 5.1 channels or 7.1 channels), which has recently prevailed.

EXAMPLES

The first invention will next be described in more detail by way of Examples.

Example 1

A liquid crystal polymer film (FA film, product of Kuraray Co., Ltd., thickness: 50 μm) onto which a two-sided adhesive tape had been attached was employed as an adhesive sheet (substrate). An enamel-coated copper wire 2 having a conductor diameter of 0.089 mm (cross-sectional area: 0.0062 $mm^2$) was applied onto a substrate 4 so as to form a coil pattern shown in FIG. 4, and subsequently, a liquid crystal polymer film (FA film, product of Kuraray Co., Ltd., thickness: 50 ↑m) having the same dimensions as those of the substrate 4 was attached onto the substrate 4 so as to cover the coil pattern, to thereby produce a vibrating diaphragm for a planer acoustic transducer.

Each of coils 6 has outer peripheral dimensions of 10 mm×10 mm, inner peripheral dimensions of 5 mm×5 mm, and seven wire turns. Reference letters a, b, c, etc. in FIG. 4 denote the order of application of the enamel-coated copper wire 2.

Ten vibrating diaphragms were produced by means of the above-described method. Table 1 shows the results of measurement of the resistances of the respective vibrating diaphragms. No circuit breakage occurred, and variation in resistance was small; i.e., the resistance variation fell within a range of ±10% of the average value (4.3Ω) (i.e., a range of ±0.4Ω).

Comparative Example 1

Figure 5:
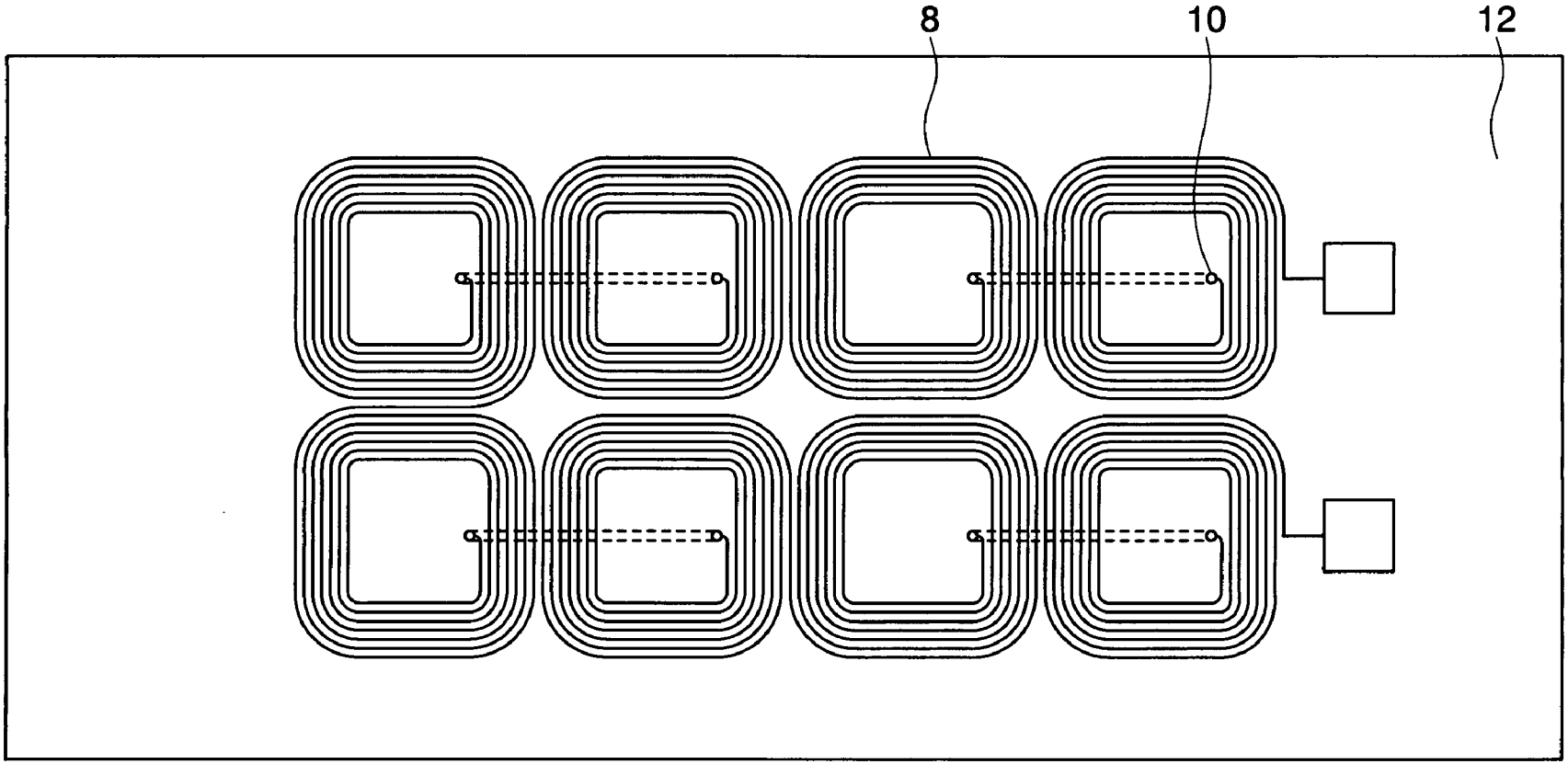
FIG. 5 is a schematic representation showing another vibrating diaphragm including a plurality of spiral coils (etching-type coils).

An electrolytic copper foil (thickness: 18 μm) was attached onto both surfaces of a liquid crystal polymer film (FA film, product of Kuraray Co., Ltd., thickness: 50 μm) through thermal pressing, to thereby prepare a substrate, and coils having a pattern shown in FIG. 5 were formed on the substrate by means of the subtractive method.

The outer peripheral dimensions, inner peripheral dimensions, and wire turns of each of coils 8 were regulated so as to be identical to those of the coils of Example 1, and the width and thickness of the circuit were determined to 0.200 mm and 0.030 mm, respectively, such that the cross-sectional area of the circuit became nearly equal to that of the circuit of Example 1. As shown by broken lines in FIG. 5, adjacent coils 8 were electrically connected by forming, via through-holes 10, a circuit on the back surface of a substrate 12. In FIG. 5, portions shown by the broken lines represent a circuit pattern formed on the back surface.

In a manner similar to that of Example 1, 10 vibrating diaphragms were produced by means of the above-described method. Table 1 shows the results of measurement of the resistances of the respective vibrating diaphragms. Circuit breakage occurred in one of the 10 diaphragms during etching, and variation in resistance was large; i.e., the resistance variation exceeded a range of ±10% of the average value (4.5Ω).

Example 2

The procedure of Example 1 was repeated, except that an aramid film (Aramica 045R, product of Asahi Kasei Corporation, thickness: 4.5 μm) onto which an epoxy resin adhesive had been applied was employed as an adhesive sheet (substrate), and that an enamel wire having a conductor diameter of 0.064 mm (cross-sectional area: 0.0032 $mm^2$) was employed as an insulation-coated conductor, to thereby produce a vibrating diaphragm for a planer acoustic transducer.

Ten vibrating diaphragms were produced by means of the above-described method. Table 1 shows the results of measurement of the resistances of the respective vibrating diaphragms. No circuit breakage occurred, and variation in resistance was small; i.e., the resistance variation fell within a range of ±10% of the average value (8.2Ω) (i.e., a range of ±0.8 Ω).

Comparative Example 2

An electrolytic copper foil (thickness: 18 μm) was attached onto both surfaces of an aramid film (Aramica 045R, product of Asahi Kasei Corporation, thickness: 4.5 μm) by use of an epoxy resin adhesive, to thereby prepare a substrate, and, in a manner similar to that of Comparative Example 1, coils having a pattern shown in FIG. 5 were formed on the substrate by means of the subtractive method. In this case, the width and thickness of the circuit were determined to 0.100 mm and 0.030 mm, respectively, such that the cross-sectional area of the circuit became nearly equal to that of the circuit of Example 2.

Ten vibrating diaphragms were produced by means of the above-described method. Table 1 shows the results of measurement of the resistances of the respective vibrating diaphragms. Circuit breakage occurred in three of the 10 diaphragms during etching, and the average of the resistances was increased by about 2Ω as compared with that in the case of Example 2. The circuit width of each of the vibrating diaphragms was measured at four points thereof by use of a micrograph (×200) of the diaphragm, and as a result, the average of the thus-measured values was found to be 0.085 mm; i.e., the average value was smaller than the above-determined circuit width.

TABLE 1

| Resistance (Ω) | | | |
|---|---|---|---|
| Example 1 | Comparative Example 1 | Example 2 | Comparative Example 2 |
| 4.0 | 4.5 | 8.3 | Circuit breakage |
| 4.3 | 5.2 | 7.9 | 10.3 |
| 4.2 | 4.7 | 8.0 | 9.7 |
| 4.4 | 4.1 | 8.4 | 10.0 |
| 4.2 | Circuit breakage | 8.1 | 11.0 |
| 4.5 | 4.4 | 7.8 | 10.4 |
| 4.3 | 3.9 | 8.0 | 10.7 |

TABLE 1-continued

| | Resistance (Ω) | | | |
|---|---|---|---|---|
| | Example 1 | Comparative Example 1 | Example 2 | Comparative Example 2 |
| | 4.3 | 4.2 | 8.2 | Circuit breakage |
| | 4.0 | 4.5 | 8.2 | Circuit breakage |
| | 4.6 | 4.9 | 8.4 | 10.9 |
| | 4.3 | 4.8 | 8.5 | 11.0 |
| Average value | 4.3 | 4.5 | 8.2 | 10.4 |
| Variation | ±0.3 | +0.7, −0.6 | +0.3, −0.4 | +0.6, −0.7 |

Example 3

Thirty-two neodymium magnets (4×8 magnets), each having a length of 10 mm, a width of 10 mm, and a thickness of 3 mm, were arranged on a flat yoke, a non-woven fabric sheet was attached onto the magnets, and a wiring-type vibrating diaphragm was arranged so as to face the magnets, to thereby produce a planer acoustic transducer. The wiring-type vibrating diaphragm was formed by applying an adhesive onto a PET film, and applying a copper wire (diameter: 0.18 mm) onto the adhesive so as to form a coil pattern. Separately, in a manner similar to that described above, there was produced a planer acoustic transducer including an etching-type vibrating diaphragm having coils formed through etching, and the planer acoustic transducer was employed for comparison.

The above-produced planer acoustic transducers were subjected to sound testing. Specifically, the test was performed on the following measurement samples: a. the 4×8 type planer acoustic transducer including the wiring-type vibrating diaphragm (resistance: 6.6Ω, coil cross-sectional area: 0.025 $mm^2$); and b. the 4×8 type planer acoustic transducer including the etching-type vibrating diaphragm (resistance: 5.6Ω, coil cross-sectional area: 0.011 $mm^2$). Each of the measurement samples, serving as a sound drive, was bonded to a center portion of a polystyrene foam plate (540 mm in length×380 mm in width×6 mm in thickness), and the sample was subjected to measurement of sound pressure-frequency characteristics in a simple anechoic chamber.

Figure 6:
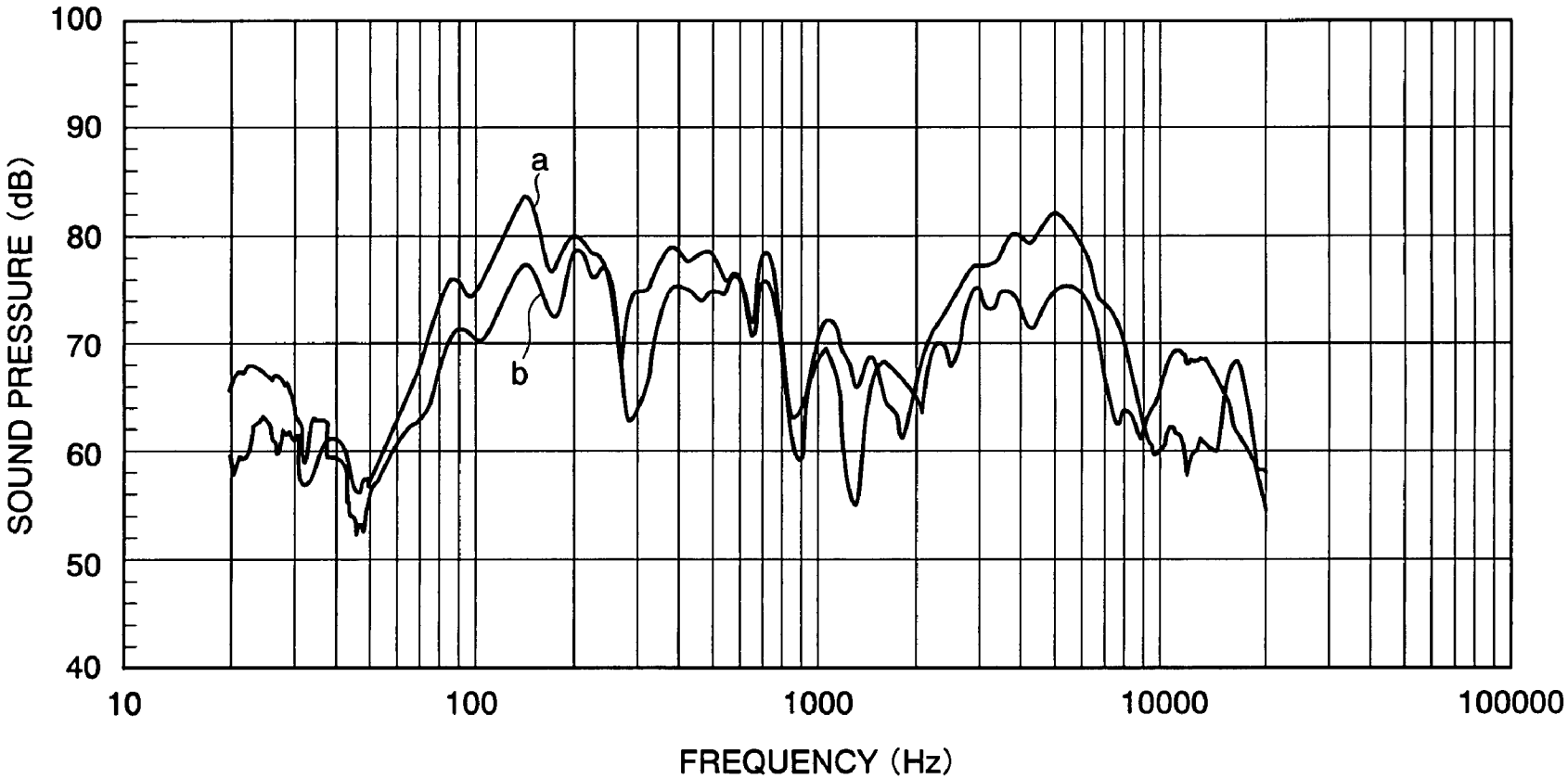
FIG. 6 is a graph showing the results of measurement of sound pressure-frequency characteristics of the measurement samples employed in Example 3.

FIG. 6 shows the results of measurement of sound pressure-frequency characteristics of the samples, as measured under the following conditions: measurement power: 1 W, measurement distance: 50 cm. In FIG. 6, a shows the results of the planer acoustic transducer including the wiring-type vibrating diaphragm, and b shows the results of the planer acoustic transducer including the etching-type vibrating diaphragm. As is clear from FIG. 6, in the planer acoustic transducer of the first invention, the coil cross-sectional area can be increased as compared with the case of the conventional planer acoustic transducer, and therefore the drive force increases, resulting in an increase in sound pressure.

The second invention will next be described in more detail by way of Examples.

Example 4

Figure 15:
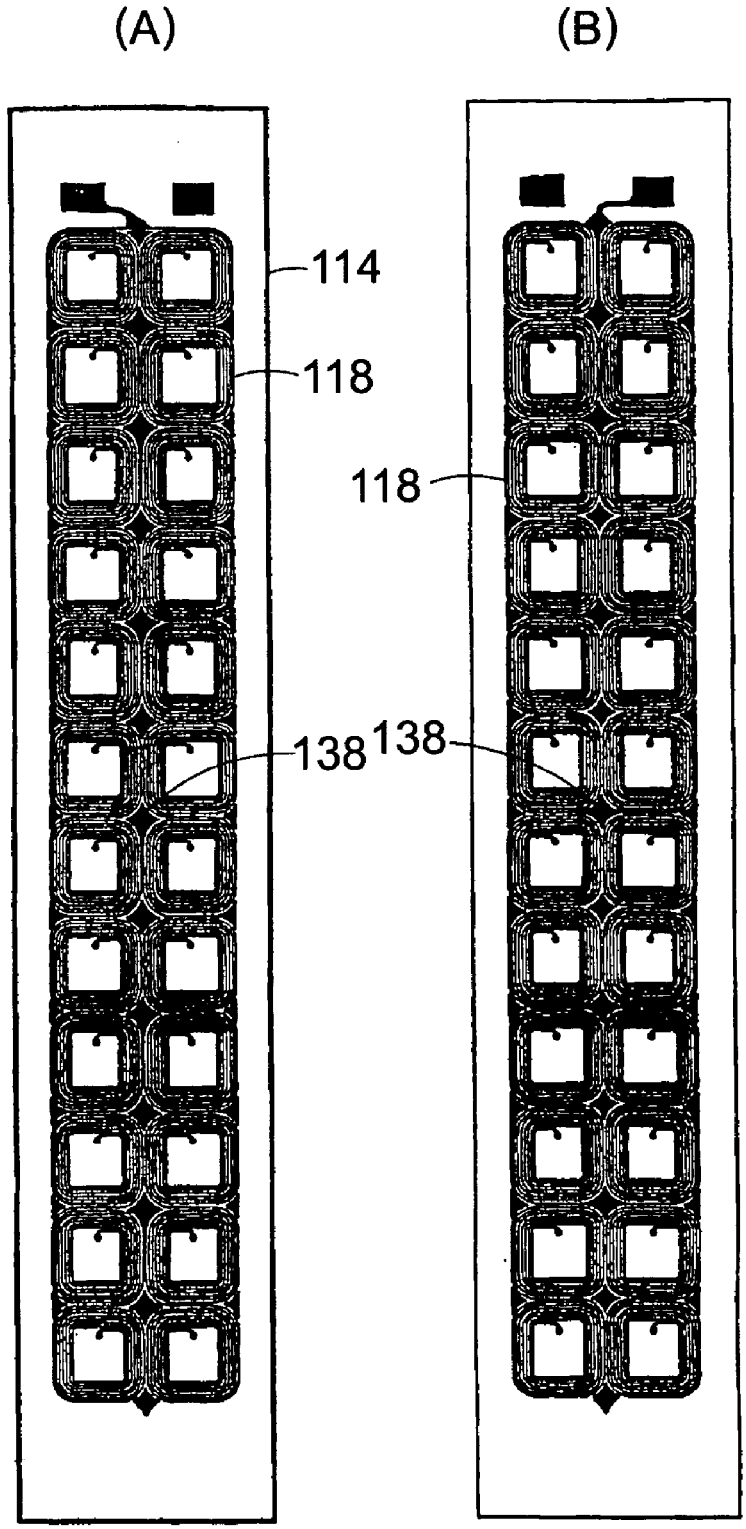
FIG. 15(A) is a top plan view showing a vibrating diaphragm employed in an example in relation to the second invention.
FIG. 15(B) is a bottom plan view of the vibrating diaphragm.
Figure 16:
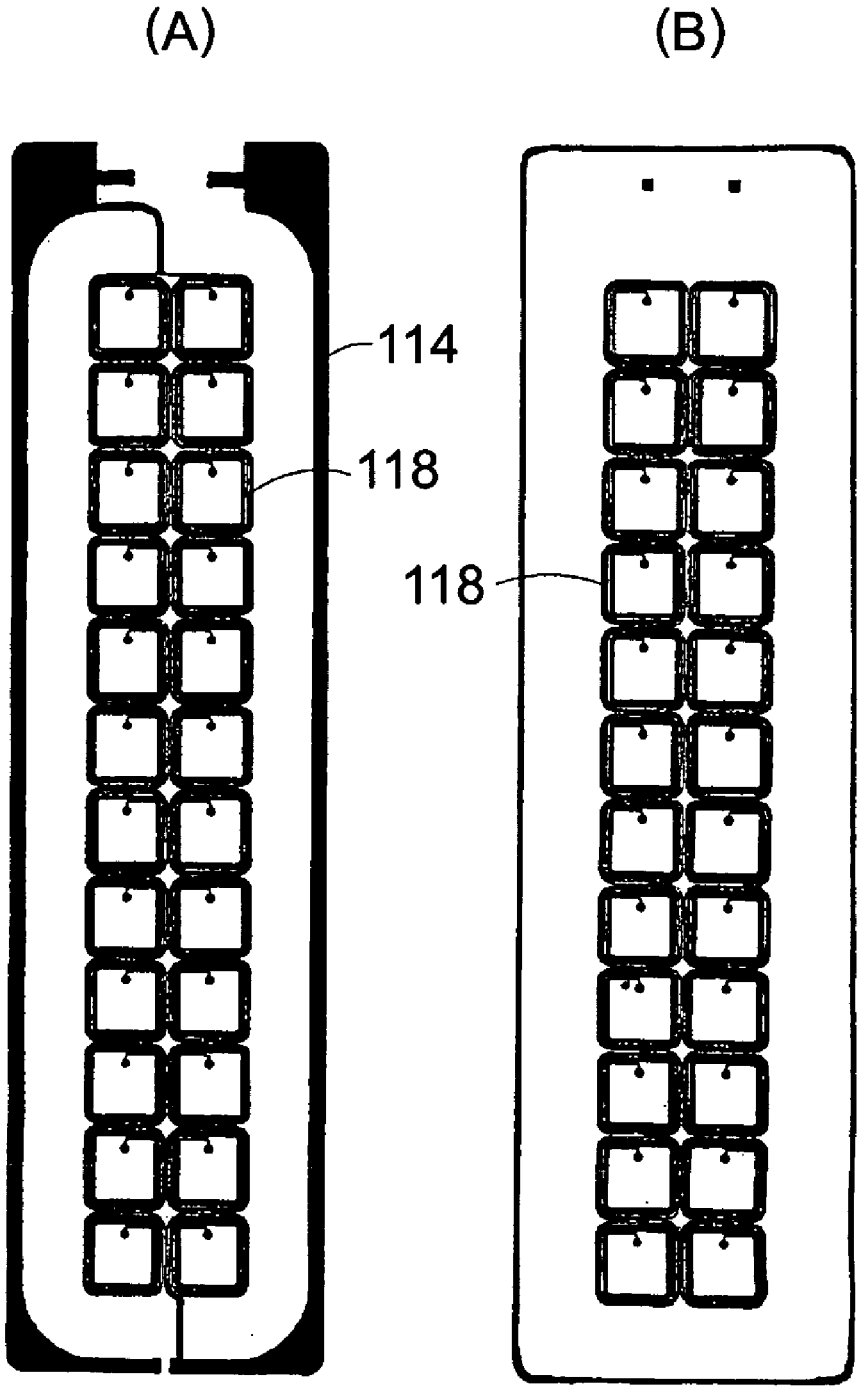
FIG. 16(A) is a top plan view showing a conventional vibrating diaphragm employed for comparison with the vibrating diaphragm of FIG. 15.
FIG. 16(B) is a bottom plan view of the conventional vibrating diaphragm.
Figure 17:
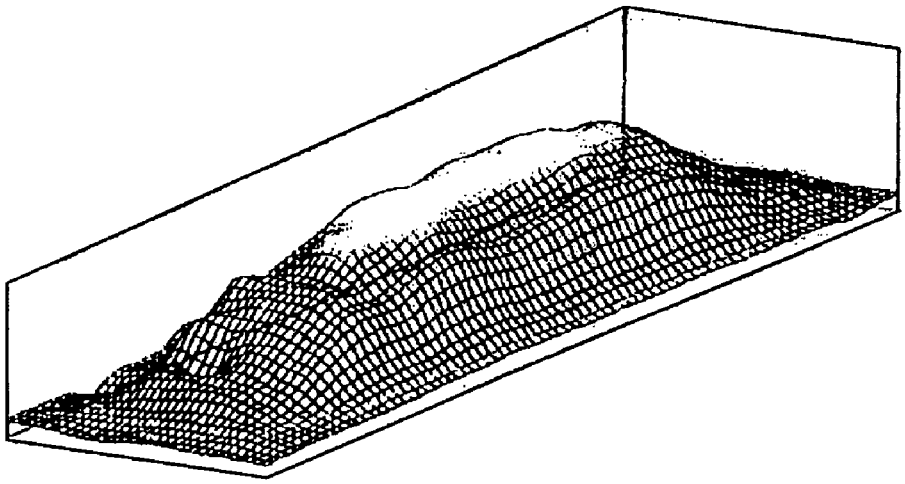
FIG. 17 is a graph showing the results of measurement of displacement of a vibrating diaphragm, the displacement being measured by use of a scanning laser Doppler vibrometer.

Voice coils (2×12 coils) were arranged on each of the surfaces of a polyester film serving as an insulting base film, to thereby form a vibrating diaphragm as shown in FIGS. 15 and 16 (dimensions: 30×140 mm), and subsequently neodymium magnets (2×12 magnets) were arranged so as to face the voice coils of the vibrating diaphragm, to thereby produce a planer acoustic transducer. The vibration behavior corresponding to the first vibration mode of the planer acoustic transducer was measured by use of a scanning laser Doppler vibrometer system (PSV-100, product of Polytec, Germany). The results are shown in FIG. 17. As shown in the figure, the maximum displacement occurs at a center portion of the vibrating diaphragm.

Figure 18:
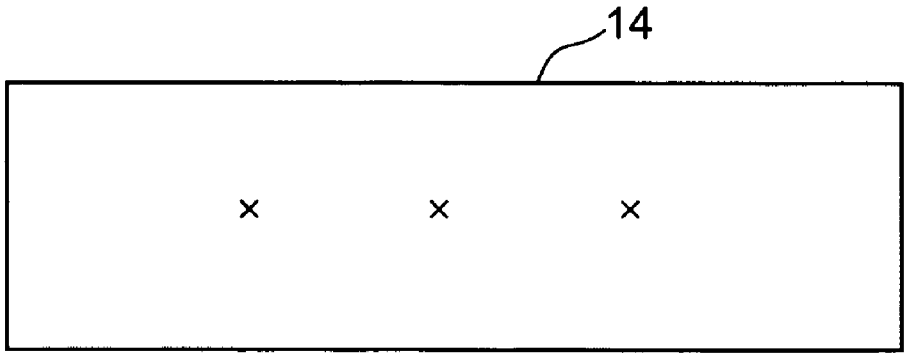
FIG. 18 is an explanatory view showing portions of the vibrating diaphragm of FIG. 16, at which wire breakage of voice coils occurs.
Figure 25:
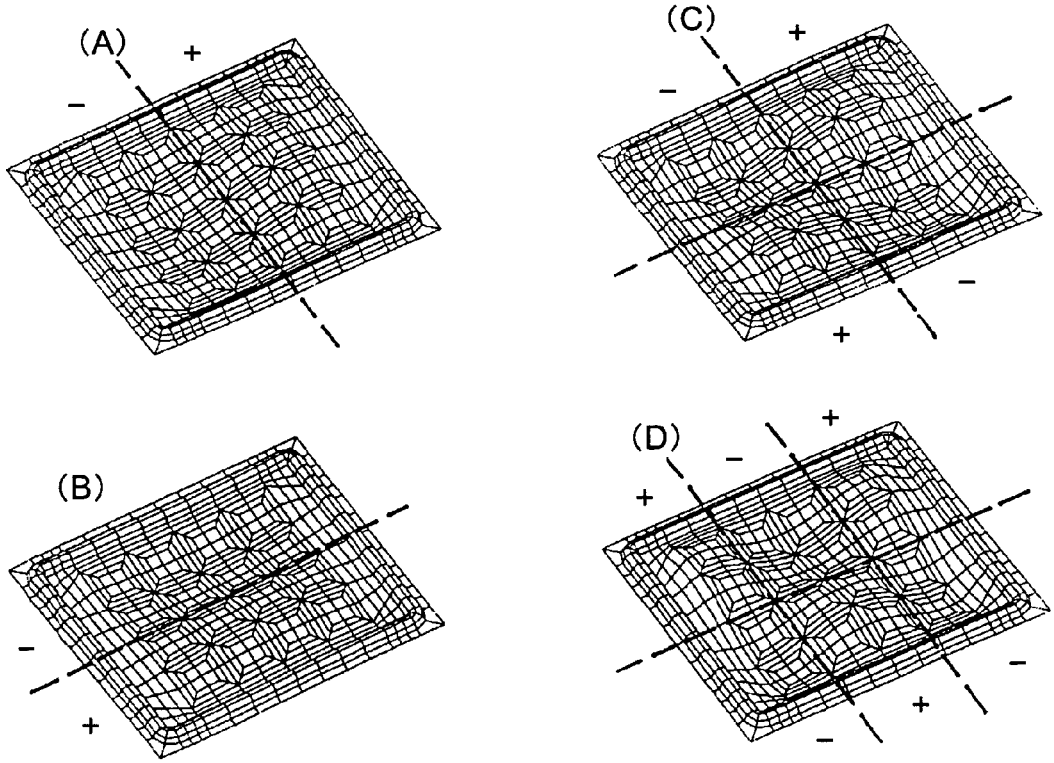
FIGS. 25(A) through 25(D) are explanatory views showing vibration modes that do not contribute to sound pressure, the vibration modes being obtained from the results of vibration mode analysis of a vibrating diaphragm.
Figure 26:
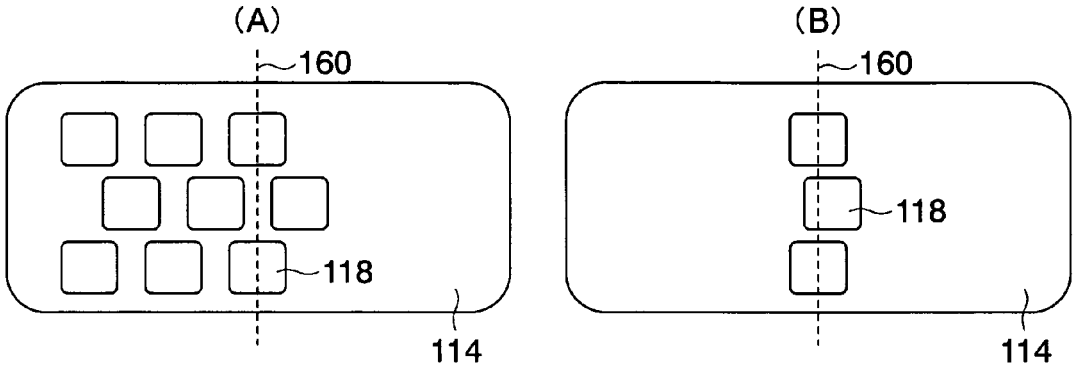
FIG. 26 is an explanatory view showing an embodiment of the second invention.

The vibrating diaphragm shown in FIG. 15 corresponds to the second embodiment of the second invention, in which rhombic, island-like patterns 138, serving as a rigidity-imparting member, are formed, whereas the vibrating diaphragm shown in FIG. 16 corresponds to a conventional vibrating diaphragm having no such island-like patterns. There were produced 25 planer acoustic transducers including the vibrating diaphragm of FIG. 15, and 25 planer acoustic transducers including the vibrating diaphragm of FIG. 16. All the thus-produced planer acoustic transducers were subjected to long-term continuous testing. As a result, no wire breakage occurred in any of the 25 planer acoustic transducers including the vibrating diaphragm of FIG. 15. In contrast, wire breakage occurred in three of the 25 planer acoustic transducers including the vibrating diaphragm of FIG. 16. Wire breakage was observed at portions of the vibrating diaphragm marked with "x" shown in FIG. 18, which portions correspond to the loops of the first and second vibration modes.

For formation of the vibrating diaphragm of FIG. 15, the etching method or the additive method was employed. Wire breakage did not occur in the diaphragm formed through the etching method nor in the diaphragm formed through the additive method.

For the case where the vibrating diaphragms of FIGS. 15 and 16 were formed through the etching method, the case in which electrolytic copper foil is used as the copper foil of a double-side, copper-clad laminate and the case in which rolled copper foil is used as the copper foil of the double-side, copper-clad laminate were compared. Regarding the vibration diaphragm of FIG. 15, wire breakage did not occur in the case where the electrolytic copper foil was employed nor in the case where the rolled copper foil was employed. In contrast, regarding the vibrating diaphragm of FIG. 16, wire breakage occurred in both the above cases.

Example 5

Figure 19:
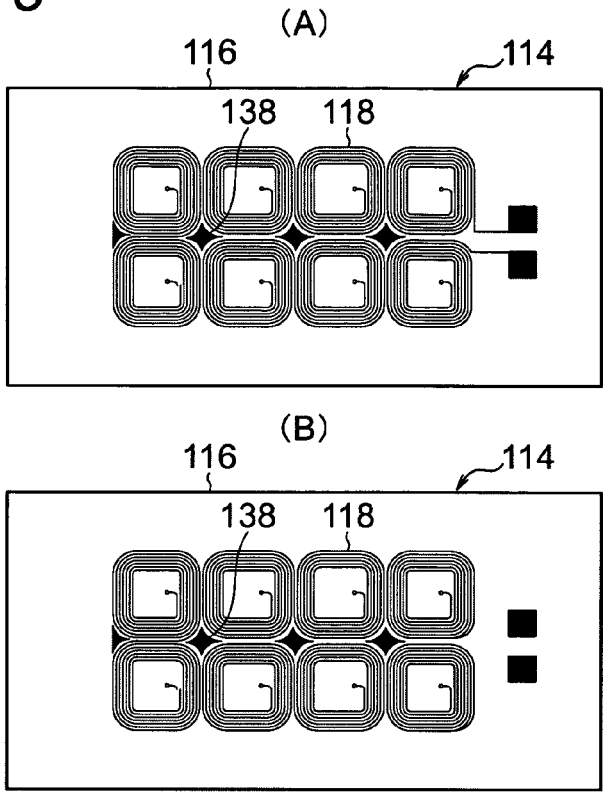
FIG. 19(A) is a top plan view showing a vibrating diaphragm employed in another example in relation to the second invention.
FIG. 19(B) is a bottom plan view of the vibrating diaphragm.
Figure 20:
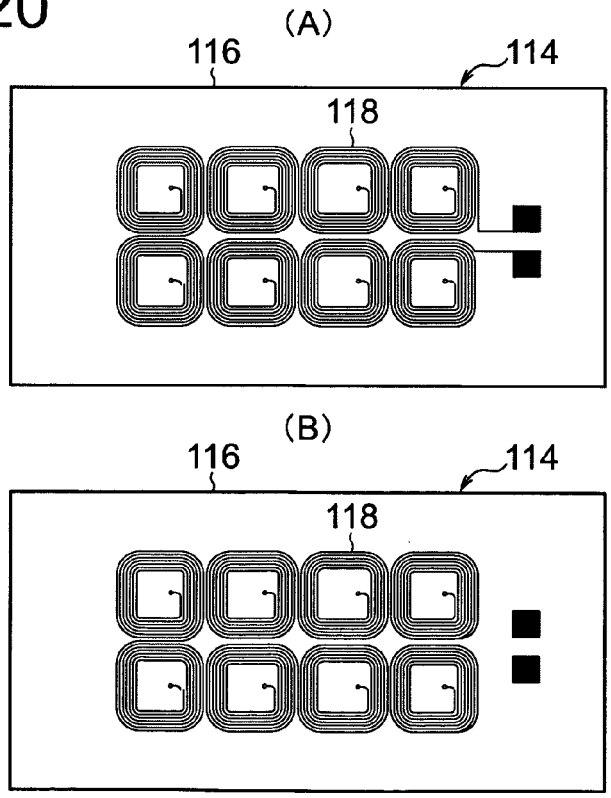
FIG. 20(A) is a top plan view showing a conventional vibrating diaphragm employed for comparison with the vibrating diaphragm of FIG. 19.
FIG. 20(B) is a bottom plan view of the conventional vibrating diaphragm.

Voice coils 118 (2×4 coils) were formed from a copper foil on each of the surfaces of an insulating base film 116, to thereby form a vibrating diaphragm 114 as shown in FIG. 19 or 20, and a planer acoustic transducer was produced by use of the thus-formed diaphragm. The vibrating diaphragm shown in FIG. 19 corresponds to the second embodiment of the second invention, in which rhombic, island-like patterns 138, serving as a rigidity-imparting member, are formed, whereas the vibrating diaphragm 114 shown in FIG. 20 corresponds to a conventional vibrating diaphragm having no such island-like patterns. FIG. 19(A) or 20(A) is a top plan view of the vibrating diaphragm 114, and FIG. 19(B) or 20(B) is a bottom plan view of the vibrating diaphragm 114.

The above-produced two types of planer acoustic transducers were subjected to 3,500-hour continuous load test under the conditions specified by JIS, and as a result, no wire breakage occurred in any of the planer acoustic transducers. Subsequently, the planer acoustic transducers were subjected to continuous test (acceleration test) with rectangular wave input whose level is three times that of rated power. As a result, wire breakage occurred in half of the conventional planer acoustic transducers including the vibrating diaphragm of FIG. 20 when 400 hours elapsed after initiation of the acceleration test. In contrast, no wire breakage occurred in the planer acoustic transducers of the second invention including the vibration diaphragm of FIG. 19 until 1,500 hours elapsed after initiation of the acceleration test.

The vibrating diaphragm of FIG. 19 or 20 was formed by use of an aluminum foil in place of a copper foil, and a planer acoustic transducer was produced by use of the vibrating diaphragm. Testing the planer acoustic transducer in a manner similar to that described above produced results similar to those obtained above.

Example 6

Figure 21:
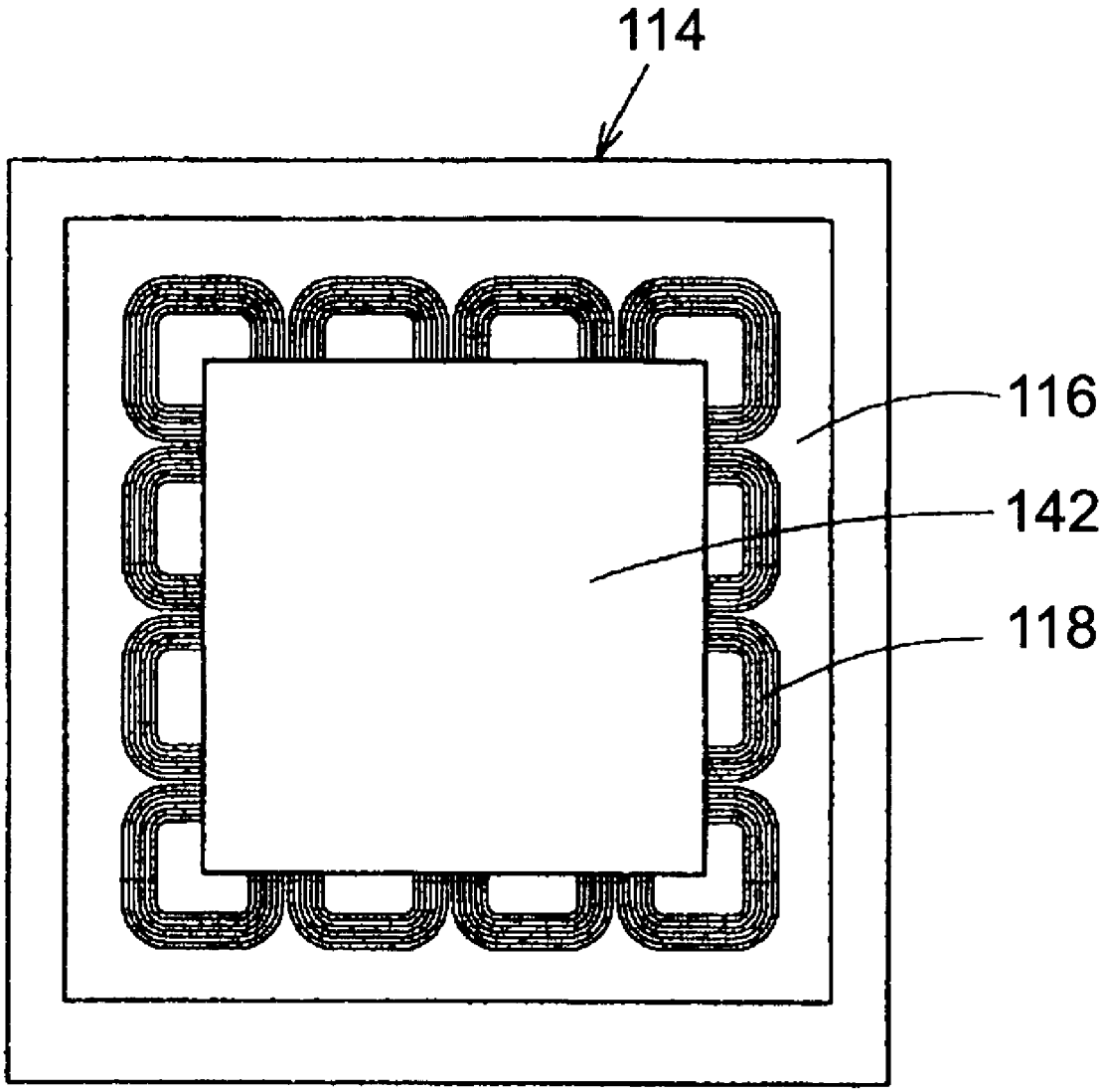
FIG. 21 is an explanatory view showing a vibrating diaphragm of an example in relation to the second invention, the diaphragm having a foam sheet attached thereon.

A copper-clad aluminum wire (outer diameter ϕ: 0.19 mm) coated with polyurethane was applied onto an insulating base film (PET film having a thickness of 25 μm), to thereby form a vibrating diaphragm having voice coils 118 (4×4 coils) as shown in FIG. 21. A PET foam sheet 142 was attached onto the thus-formed vibrating diaphragm, thereby producing the planer acoustic transducer of the second invention (corresponding to the fourth embodiment). Separately, a conventional planer acoustic transducer including no foam sheet was produced by use of the above-formed vibration diaphragm. Each of the thus-produced planer acoustic transducers has dimensions of 68 mm×78 mm×8 mm. The above-attached foam sheet (30 mm×30 mm) was prepared from a material having a thickness of 1 mm, a density of 0.27 g/cm$^3$, an expansion ratio of 5, an average bubble diameter of 110 μm or less, a tensile elastic modulus of 97.3 MPa, a flexural elastic modulus of 1,650 MPa, and a thermal deformation temperature of 117° C.

Figure 22:
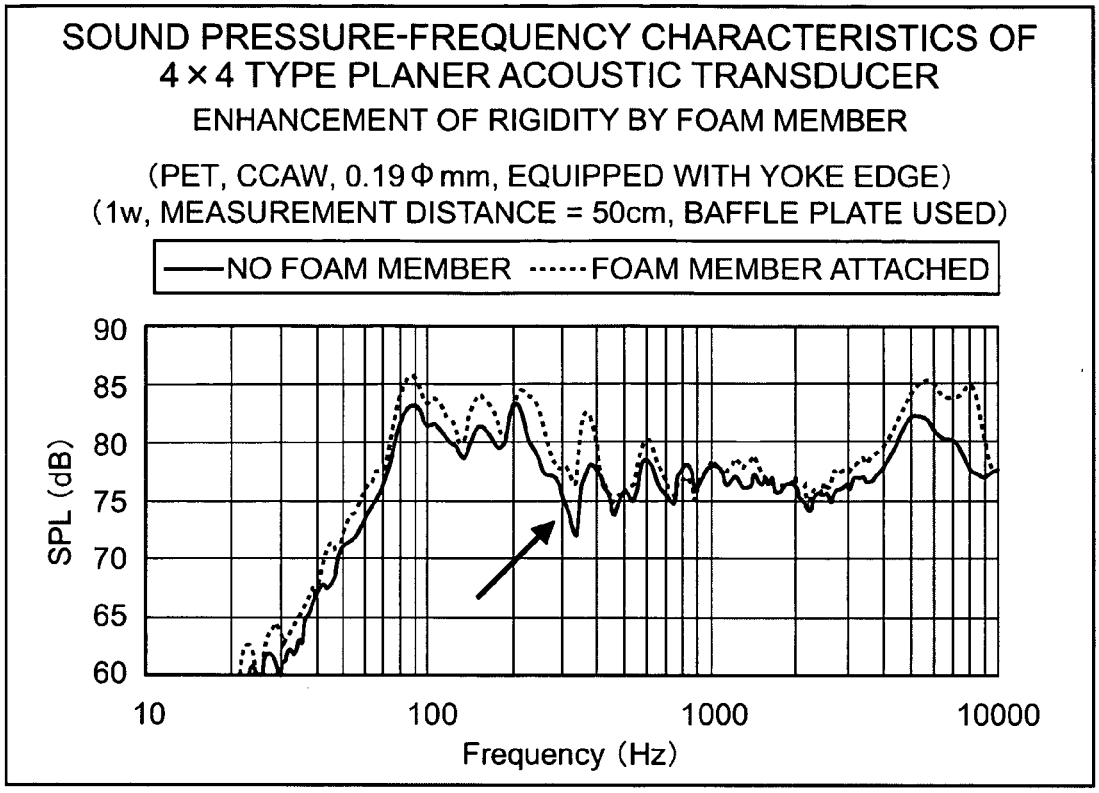
FIG. 22 is a graph showing the sound pressure-frequency characteristics of a planer acoustic transducer of the second invention including the vibrating diaphragm of FIG. 21 and a conventional planer acoustic transducer including no foam sheet.

These planer acoustic transducers were subjected to measurement of sound pressure-frequency characteristics. The results are shown in FIG. 22. In FIG. 22, curve a shows the characteristics of the planer acoustic transducer of this Example, and curve b shows the characteristics of the conventional planer acoustic transducer including no foam sheet. As is clear from FIG. 22, in the case of the conventional planer acoustic transducer including no foam sheet, a significant midrange trough (a portion shown by the arrow) occurs in the vicinity of 330 Hz, whereas in the case of the planer acoustic transducer of the second invention including the foam sheet, occurrence of a midrange trough is reduced; i.e., the quality of midrange sound is improved.

Example 7

Figure 23:
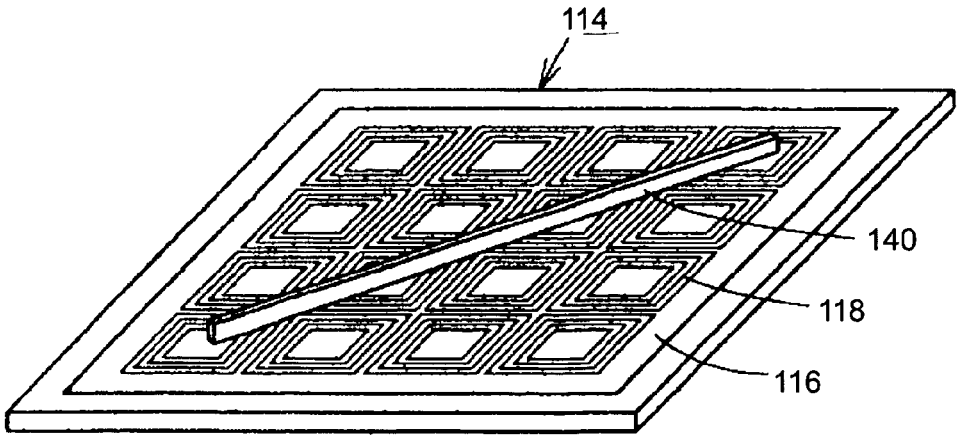
FIG. 23 is an explanatory view showing a vibrating diaphragm of an example in relation to the second invention, the diaphragm having a rib attached thereon.

A polyurethane-coated copper wire (copper wire outer diameter: 0.15 mm) was applied onto an insulating base film (PET film having a thickness of 25 μm), to thereby form a vibrating diaphragm having voice coils 118 (4×4 coils) as shown in FIG. 23. A foam rib 140 was attached onto the thus-formed vibrating diaphragm, thereby producing the planer acoustic transducer of the second invention (corresponding to the third embodiment). Separately, a conventional planer acoustic transducer including no foam rib was produced by use of the above-formed vibration diaphragm. Each of the thus-produced planer acoustic transducers has dimensions of 68 mm×78 mm×8 mm. The above-attached foam rib (10 mm×40 mm) was prepared from a material having a thickness of 2 mm, a density of 0.27 g/cm$^3$, an expansion ratio of 5, an average bubble diameter of 10 μm or less, a tensile elastic modulus of 97.3 MPa, a flexural elastic modulus of 1,650 MPa, and a thermal deformation temperature of 117° C.

Figure 24:
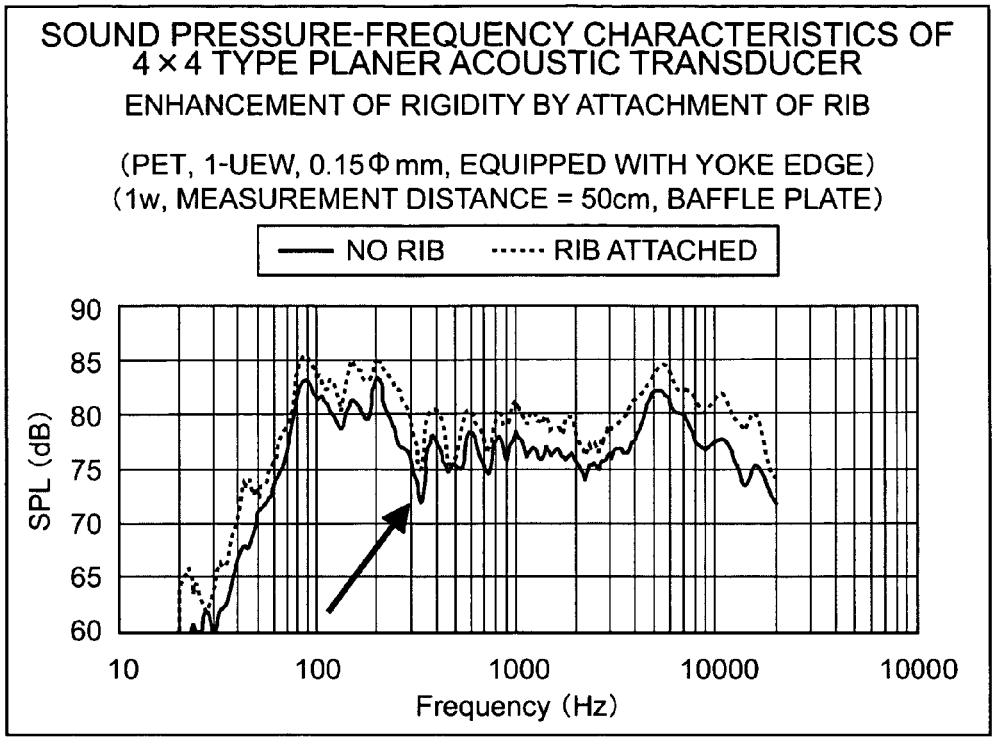
FIG. 24 is a graph showing the sound pressure-frequency characteristics of a planer acoustic transducer of the second invention including the vibrating diaphragm of FIG. 23 and a conventional planer acoustic transducer including no rib.

These planer acoustic transducers were subjected to measurement of sound pressure-frequency characteristics. The results are shown in FIG. 24. In FIG. 24, curve a shows the characteristics of the planer acoustic transducer of this Example, and curve b shows the characteristics of the conventional planer acoustic transducer including no foam rib. As is clear from FIG. 24, in the case of the planer acoustic transducer of the second invention including the foam rib, occurrence of a midrange trough (a portion shown by the arrow) in the vicinity of 330 Hz is reduced; i.e., the quality of midrange sound is improved, as compared with the case of the conventional planer acoustic transducer including no foam rib. As is also clear from FIG. 24, over the entire frequency range, the sound pressure of the planer acoustic transducer of this Example is higher by 2 to 3 dB than that of the conventional planer acoustic transducer, and particularly in a high-frequency range of 8 kHz or more, the sound pressure of the Example planer acoustic transducer is higher by 3 to 4 dB than that of the conventional planer acoustic transducer.

Example 8

A vibrating diaphragm including voice coils (4×4 coils) was subjected to vibration mode analysis. The analysis was performed by use of MARC program (product of Nippon MARC Co., Ltd.) employing, as parameters, the material physical properties (Young's modulus, Poisson ratio, and density) and the shape (two-dimensional shape and thickness) of the voice coils, insulating base film, resin, and edge constituting the vibrating diaphragm. The vibration mode was visualized by use of the eigenvector, since the eigenvector represents the displacement vector.

FIGS. 25(A) through 25(D) show low-order vibration modes that do not contribute to sound pressure, which were obtained from the results of the vibration mode analysis. In the figures, a broken line represents the node of vibration. In the figures, symbol "+" or "−" represents vibration displacement at a certain point in time, and symbols "+" and "−" represent the upward and downward displacements with respect to the plane of the sheet, respectively. In the vibration modes shown in FIGS. 25(A) through 25(D), the displacements of the vibrating diaphragm are canceled out, and sound pressure is not effectively generated.

In the case of the planer acoustic transducer of the second invention, in which a foam member, a rib, or a thermosetting resin was attached onto a portion of the vibrating diaphragm that corresponds to the loop of vibration, thereby enhancing the rigidity of the diaphragm, the maximum amplitude was reduced, as compared with the case of the conventional planer acoustic transducer, in which treatment for rigidity enhancement was not performed. The maximum amplitude was measured by use of a scanning laser Doppler vibrometer (product of Polytec) and LC-2430 (product of Keyence Corporation). Even when the planer acoustic transducer exhibiting reduced maximum amplitude was subjected to long-term continuous testing, wire breakage of the voice coils did not occur.

The third invention will next be described in more detail by way of Examples.

Example 9

Sixteen neodymium magnets (4×4 magnets), each having a length of 7 mm, a width of 7 mm, and a thickness of 2.5 mm, were arranged on a flat yoke, a non-woven fabric sheet was attached onto the magnets, and a wiring-type vibrating diaphragm was arranged so as to face the magnets, to thereby produce a planer acoustic transducer having dimensions of 65 mm×75 mm. The wiring-type vibrating diaphragm was formed through the following procedure: an adhesive was applied onto a PEN film (thickness: 25 μm) (product of Teijin DuPont Films Japan Limited), an aluminum wire (diameter: 0.19 mm) was applied onto the adhesive so as to form a coil pattern shown in FIG. 4, and subsequently a PEN resin foam sheet having the same dimensions (exclusive of thickness) as the PEN film was attached to the PEN film so as to cover the coil pattern. The PEN foam sheet was formed by foaming a PEN film (thickness: 100 μm) (product of Nihon Matai Co., Ltd.) at an expansion ratio of 8 so as to have a thickness of 200 μm and an average bubble diameter of 10 μm.

Figure 4:
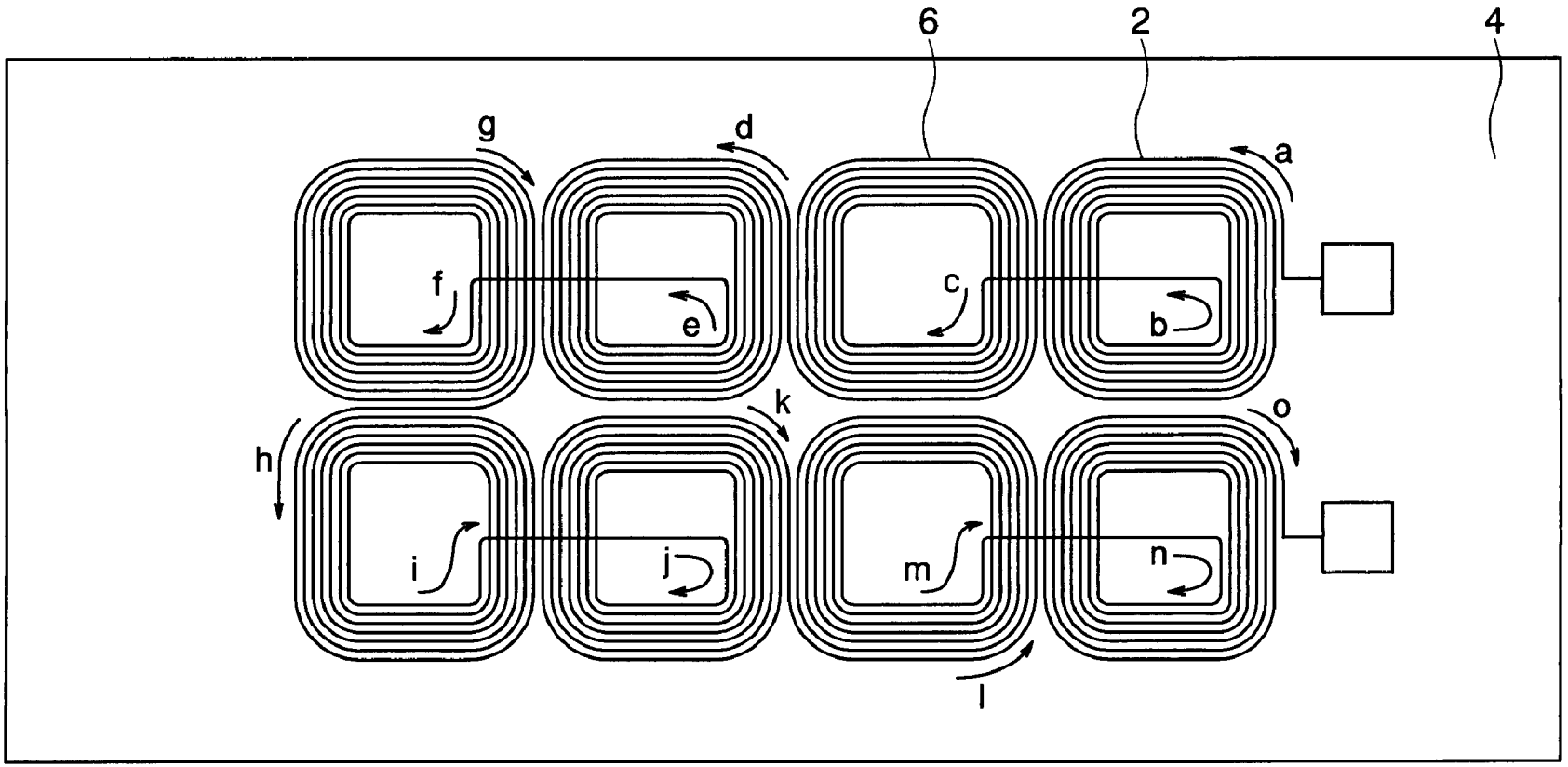
FIG. 4 is a schematic representation showing a vibrating diaphragm including a plurality of spiral coils (wiring-type coils).

In Example 9, as shown in FIG. 4, each of coils 6 has outer peripheral dimensions of 10 mm×10 mm, inner peripheral dimensions of 5 mm×5 mm, and seven wire turns. Reference letters a, b, c, etc. in FIG. 4 denote the order of application of an aluminum wire 2 onto a substrate 4. This wiring process was repeated to form 4×4 coils.

Comparative Example 3

For comparison, sixteen neodymium magnets (4×4 magnets), each having a length of 10 mm, a width of 10 mm, and a thickness of 3 mm, were arranged on a flat yoke, a non-woven fabric sheet was attached onto the magnets, and a wiring-type vibrating diaphragm was arranged so as to face the magnets, to thereby produce a planer acoustic transducer. The wiring-type vibrating diaphragm was formed through the following procedure: an adhesive was applied onto a PEN film (thickness: 25 μm) (product of Teijin DuPont Films Japan Limited), an aluminum wire (diameter: 0.19 mm) was applied onto the adhesive so as to form a coil pattern shown in FIG. 4, and subsequently a PEN film (product of Teijin DuPont Films Japan Limited) having a thickness of 25 μm and the same dimensions as the aforementioned PEN film was attached to the PEN film so as to cover the coil pattern.

That is, the above-formed vibrating diaphragm of Comparative Example 3 differs from the vibrating diaphragm of Example 9 merely in whether or not the film covering the coils has been foamed (these diaphragm are formed of the same materials and have the same weight).

The planer acoustic transducers of Example 9 and Comparative Example 3 were subjected to sound testing. Specifically, the planer acoustic transducers were subjected to measurement of sound pressure-frequency characteristics in a simple anechoic chamber by use of the standard baffle specified by JIS.

Figure 33:
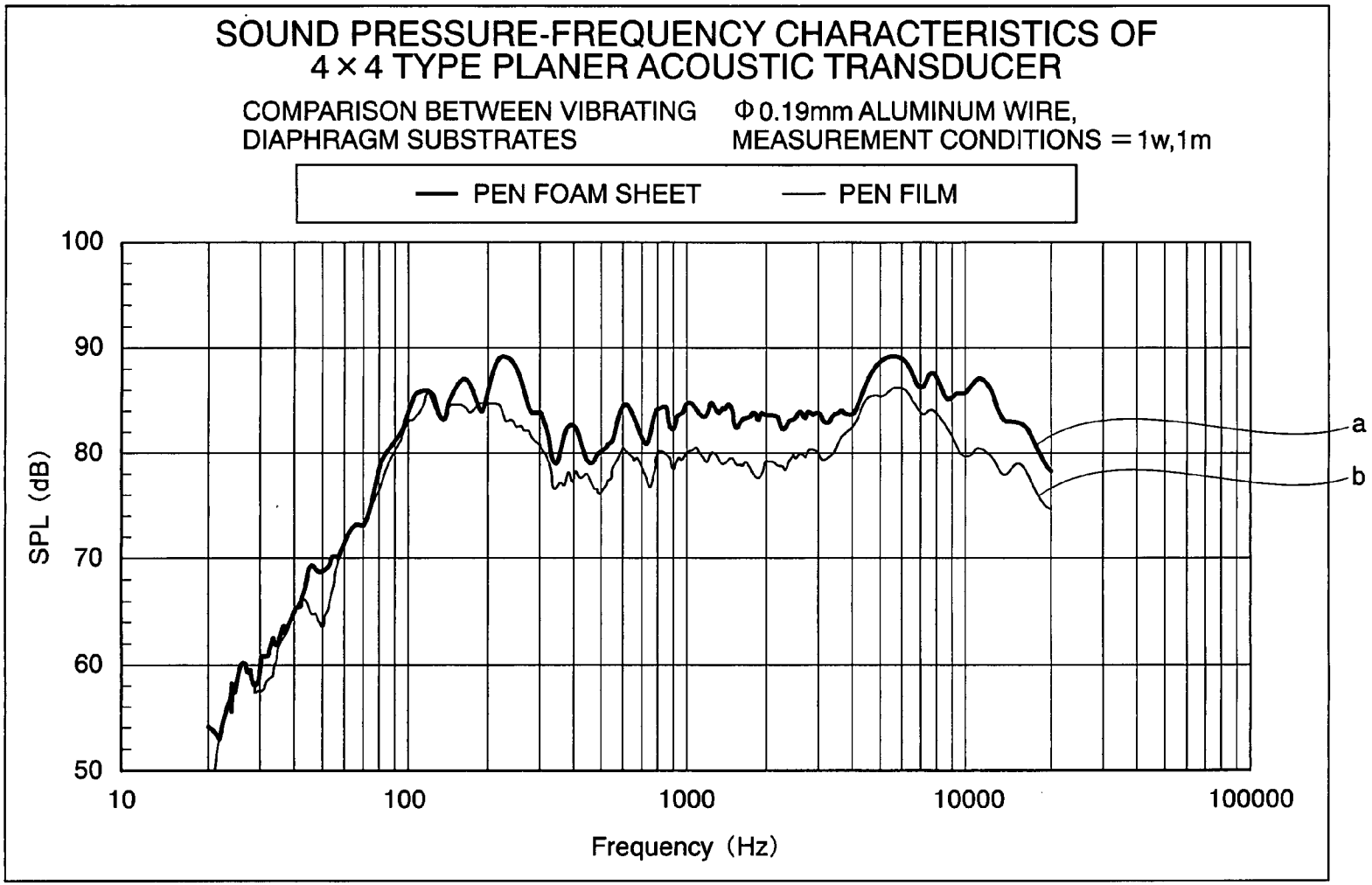
FIG. 33 is a graph showing the sound pressure-frequency characteristics of a planer acoustic transducer of the third invention including a resin foam sheet and a planer acoustic transducer including no resin foam sheet.
Figure 34:
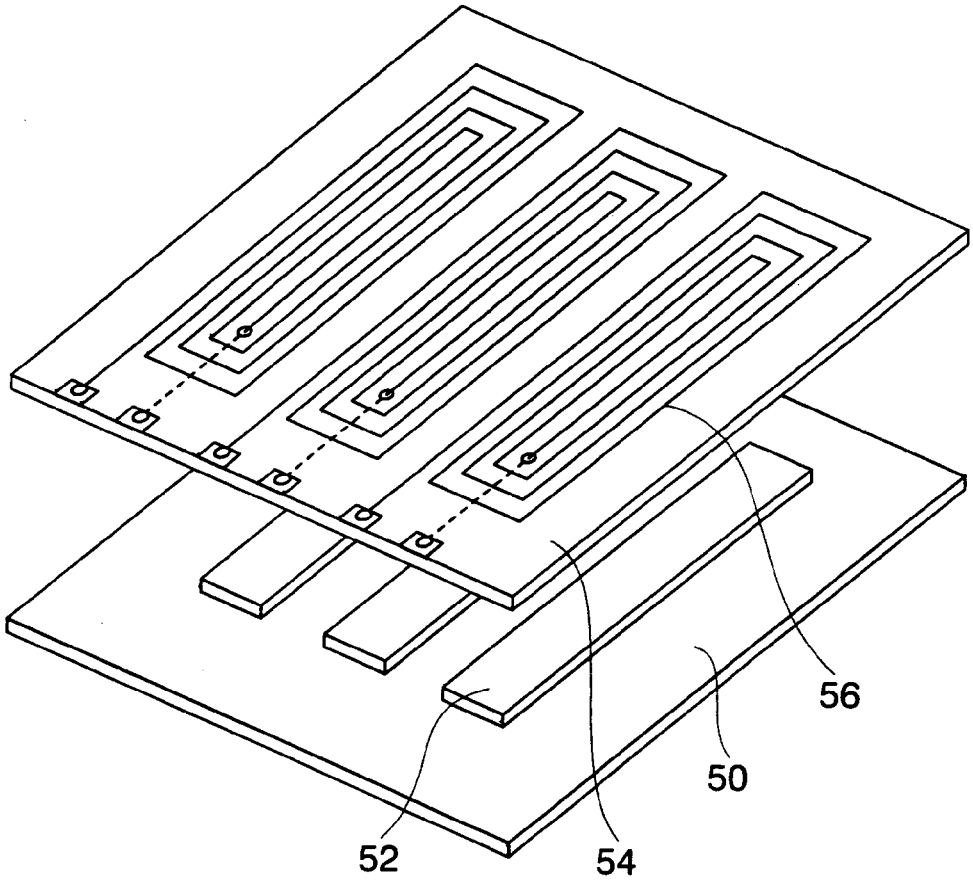
FIG. 34 (PRIOR ART)
FIG. 34 shows the configuration of a conventional thin, planer acoustic transducer.
Figure 35:
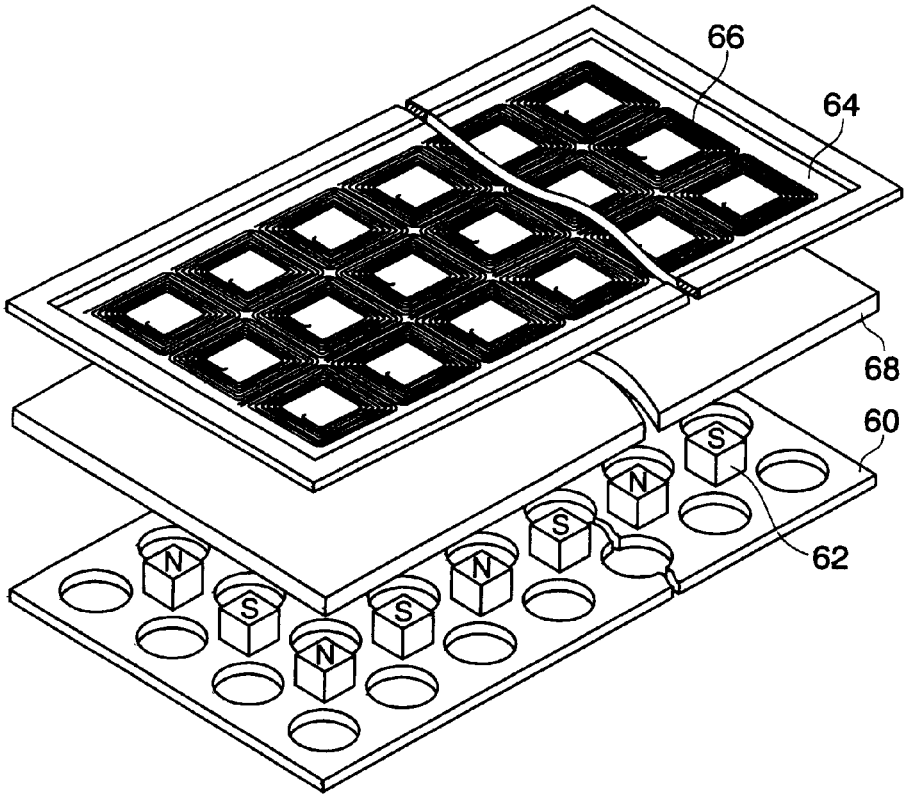
FIG. 35 (PRIOR ART)
FIG. 35 shows the configuration of another conventional thin, planer acoustic transducer.
Figure 36:
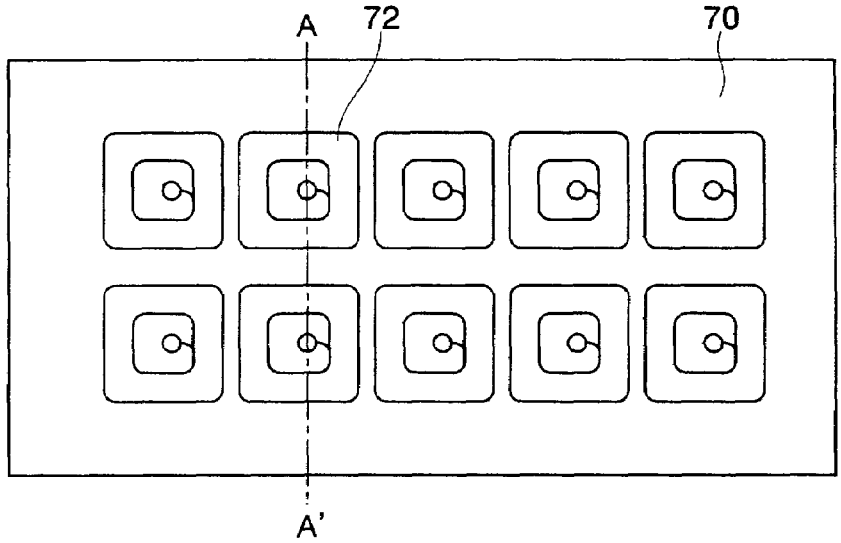
FIG. 36 (PRIOR ART)
FIG. 36 shows the structure of the vibrating diaphragm of a conventional thin, planer acoustic transducer.
Figure 36:
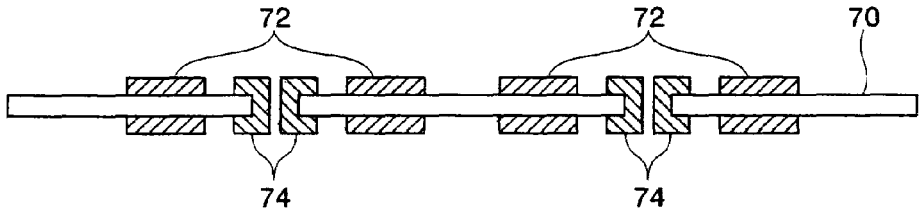
FIG. 36 (PRIOR ART)
Figure 37:
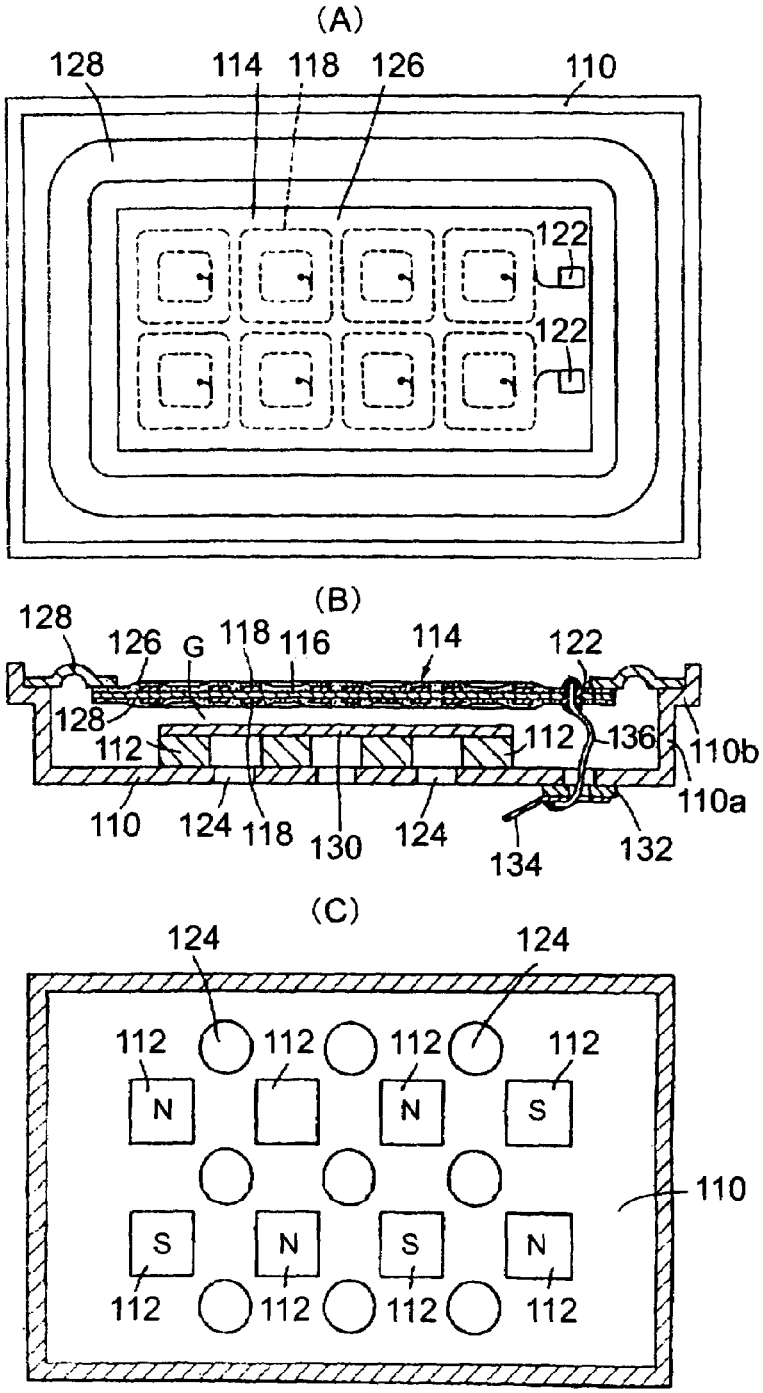
FIG. 37 (PRIOR ART)
FIG. 37(A) is a top plan view showing a general structure of a planer acoustic transducer.
FIG. 37(B) is a vertical cross-sectional view of the planer acoustic transducer structure.
FIG. 37(C) is a horizontal cross-sectional view of the planer acoustic transducer structure.

FIG. 33 shows the results of measurement of sound pressure-frequency characteristics of the planer acoustic transducers, as measured under the following conditions: measurement power: 1 W, measurement distance: 1 m. As is clear from FIG. 33, the planer acoustic transducer of the third invention, which employs the vibrating diaphragm including the PEN resin foam sheet, exhibits good vibration transmission and produces high sound pressure, since the planer acoustic transducer has high rigidity as compared with the comparative planer acoustic transducer including the non-foamed PEN resin sheet, although these planer acoustic transducers have the same weight. In FIG. 33, curve a shows the characteristics of the planer acoustic transducer of Example 9, and curve b shows the characteristics of the planer acoustic transducer of Comparative Example 3.

The present invention has been described with reference to the embodiments and Examples employing a rectangular, square, or elliptic vibration diaphragm. However, the present invention is not limited to these embodiments and Examples, and can be applied to the case where a vibrating diaphragm has a circular, triangular, pentagonal, hexagonal, octagonal, or another different shape.

INDUSTRIAL APPLICABILITY

The first invention employs a vibrating diaphragm having a coil formed through application of a wire conductor onto an adhesive sheet. Therefore, the thickness, width, and length of the conductor constituting the coil can be maintained constant, and variation in the impedance of individual vibrating diaphragms can be reduced as compared with the case of a vibrating diaphragm produced through a conventional method. When the wire conductor is an insulation-coated conductor whose surface layer has at least one insulating layer, the wiring density of the wire conductor and the degree of freedom in the wiring pattern are dramatically increased, which enables more flexible shape design and impedance design. In the planer acoustic transducer of the first invention, the coil cross-sectional area can be increased as compared with the case of a conventional planer acoustic transducer, and therefore driving force applied to the coil is increased, resulting in an increase in sound pressure. When the wire conductor is a litz wire, a coil having large conductor cross-sectional area can be formed with high precision, and thus sound pressure can be further increased.

The second invention provides a planer acoustic transducer in which a spiral voice coil provided on a vibrating diaphragm is driven. Even when the planer acoustic transducer is employed for a long period of time, the voice coil is not prone to wire breakage caused by metal fatigue. That is, the planer acoustic transducer exhibits high reliability. In addition, the planer acoustic transducer exhibits improved midrange sound quality.

The third invention employs, as a vibrating diaphragm, a resin foam sheet containing uniform, fine bubbles. Therefore, as compared with the case where a non-foamed sheet is employed, the entire vibrating diaphragm has light weight and high rigidity, and thus strain due to vibration is reduced, and sound pressure is increased. In the third invention, the type of a resin foam sheet can be selected in accordance with the environment where the planer acoustic transducer is employed, and the expansion ratio of the sheet can be arbitrarily determined. Therefore, the degree of freedom in the design of the planer acoustic transducer is increased.

The invention claimed is:

1. A planer acoustic transducer, comprising:

a vibrating diaphragm including a spiral voice coil provided on both surfaces or on one surface of an insulating base film; and a permanent magnet corresponding to the voice coil, wherein, in the vibrating diaphragm, the spiral voice coil is formed by applying a wire conductor, in a coil pattern, onto at least one surface of the base film, and wherein the wire conductor is an insulation-coated conductor whose surface layer has at least one insulating layer.

2. A planer acoustic transducer according to claim 1, wherein the wire conductor has a diameter of 0.02 mm to 0.4 mm.

3. A planer acoustic transducer according to claim 1, wherein the wire conductor is a litz wire.

4. A planer acoustic transducer according to claim 1, wherein the wire conductor contains at least one species selected from among copper, aluminum, an aluminum alloy, and copper-clad aluminum.

5. A planer acoustic transducer according to claim 1, wherein the wire conductor contains at least one species selected from among copper, a copper alloy, aluminum, an aluminum alloy, copper-clad aluminum, a copper-clad aluminum alloy, copper-plated aluminum, and a copper-plated aluminum alloy.

6. A planer acoustic transducer according to claim 1, wherein the vibrating diaphragm has a sheet-like substrate that is a heat-resistant film having an adhesive layer on a surface thereof onto which the wire conductor is applied.

7. A planer acoustic transducer according to claim 6, wherein the adhesive layer of the sheet-like substrate is formed of an acrylic resin, a silicone resin, or an epoxy resin.

8. A planer acoustic transducer according to claim 1, wherein the wire conductor applied onto the vibrating diaphragm is connected to a terminal of a tinsel wire.

9. A planer acoustic transducer according to claim 8, wherein the wire conductor applied onto the vibrating diaphragm is connected to the tinsel wire through soldering, and the solder-connected portion is coated with a resin.

10. A planer acoustic transducer according claim 1, wherein the vibrating diaphragm includes a spiral coil which is formed by applying the wire conductor onto the surface of the diaphragm that faces the magnet such that a plurality of coil segments are stacked in a thickness direction of the vibrating diaphragm.

11. An audio device comprising a planer acoustic transducer as recited in claim 1.

12. A vehicle comprising a planer acoustic transducer as recited in claim 1.

13. An automobile comprising a planer acoustic transducer as recited in claim 1.

14. An automobile comprising a planer acoustic transducer as recited in claim 1, and a door frame garnish section on which the planer acoustic transducer is provided.

15. A portable electronic device comprising a planer acoustic transducer as recited in claim 1.

* * * * *